US007329139B2

(12) United States Patent
Benham

(10) Patent No.: US 7,329,139 B2
(45) **Date of Patent: *Feb. 12, 2008**

(54) SNAP LOCK CONNECTOR

(75) Inventor: John E. Benham, Torrington, CT (US)

(73) Assignee: Winchester Electronics Corporation, Wallingford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/710,416

(22) Filed: Feb. 26, 2007

(65) Prior Publication Data

US 2007/0173100 A1 Jul. 26, 2007

Related U.S. Application Data

(63) Continuation of application No. 11/296,336, filed on Dec. 8, 2005, now Pat. No. 7,189,097.

(60) Provisional application No. 60/700,309, filed on Jul. 19, 2005, provisional application No. 60/651,637, filed on Feb. 11, 2005.

(51) Int. Cl.
*H01R 13/627* (2006.01)

(52) U.S. Cl. ..... 439/352; 439/357; 439/675; 439/609

(58) Field of Classification Search ..... 439/744, 439/745, 871, 578, 357, 352, 675, 609
See application file for complete search history.

(56) References Cited

U.S. PATENT DOCUMENTS 2,711,524 A * 6/1955 Erick ..... 439/851
2,785,384 A 3/1957 Wickesser
3,161,451 A 12/1964 Neidecker
3,193,309 A 7/1965 Morris
3,976,352 A 8/1976 Spinner
4,012,105 A 3/1977 Biddle
4,017,139 A 4/1977 Nelson
4,106,839 A 8/1978 Cooper
4,165,911 A 8/1979 Laudig
4,239,318 A * 12/1980 Schwartz ..... 439/609
4,326,768 A 4/1982 Punako
4,426,127 A 1/1984 Kubota
4,428,639 A * 1/1984 Hillis ..... 439/609
4,666,231 A 5/1987 Sheesley et al.
4,674,809 A 6/1987 Hollyday et al.
4,834,675 A 5/1989 Samchisen
4,957,456 A 9/1990 Olson et al.
4,963,105 A 10/1990 Lewis et al.
5,074,809 A 12/1991 Rousseau
5,088,937 A 2/1992 Gabany
5,176,533 A 1/1993 Sakurai et al.
5,195,904 A 3/1993 Cyvoct (Continued)

FOREIGN PATENT DOCUMENTS

DE 3117320 A1 4/1982

(Continued)

*Primary Examiner*—Tho D. Ta
*Assistant Examiner*—Vanessa Girardi
(74) *Attorney, Agent, or Firm*—Rothwell, Figg, Ernst & Manbeck

(57) ABSTRACT

The present invention, in one aspect, provides a connector apparatus that can be used in, among other things, applications requiring RF or high-speed digital electrical signals.

48 Claims, 35 Drawing Sheets

U.S. PATENT DOCUMENTS

| | | | | |
|---|---|---|---|---|
| 5,938,465 | A | 8/1999 | Fox, Sr. | |
| 6,083,030 | A | 7/2000 | Wright | |
| 6,093,043 | A | 7/2000 | Gray et al. | |
| 6,126,487 | A | 10/2000 | Rosenberger | |
| 6,132,234 | A * | 10/2000 | Waidner et al. | 439/358 |
| 6,142,812 | A | 11/2000 | Hwang | |
| 6,250,942 | B1 | 6/2001 | Lemke et al. | |
| 6,332,815 | B1 | 12/2001 | Bruce | |
| 6,379,183 | B1 * | 4/2002 | Ayres et al. | 439/578 |
| 6,464,527 | B2 | 10/2002 | Volpe et al. | |
| 6,645,011 | B2 * | 11/2003 | Schneider et al. | 439/609 |
| 6,692,286 | B1 | 2/2004 | De Cet | |
| 6,709,289 | B2 * | 3/2004 | Huber et al. | 439/578 |
| 6,749,454 | B2 | 6/2004 | Schmidt et al. | |
| 2004/0137778 | A1 | 7/2004 | Mattheeuws et al. | |
| 2006/0099853 | A1 * | 5/2006 | Sattele et al. | 439/578 |

FOREIGN PATENT DOCUMENTS

| | | | |
|---|---|---|---|
| DE | 197 49 130 | C1 | 8/1999 |
| DE | 103 46 914 | A1 | 5/2004 |
| EP | 0 299 772 | A2 | 1/1989 |
| EP | 0 350 835 | A2 | 1/1990 |
| EP | 0 867 978 | A2 | 9/1998 |
| EP | 1 069 654 | A1 | 1/2001 |
| EP | 1 094 565 | A1 | 4/2001 |
| EP | 1 115 179 | A2 | 7/2001 |
| EP | 1 455 420 | A1 | 9/2004 |
| FR | 2 204 331 | | 5/1974 |
| SU | 340537 | | 10/1959 |
| WO | WO 00/05785 | A1 | 2/2000 |

* cited by examiner

SNAP LOCK CONNECTOR

The present application is a continuation of application Ser. No. 11/296,336, filed Dec. 8, 2005 now U.S. Pat. No. 7,189,097, which claims the benefit of U.S. Provisional Patent Application Nos.: 60/700,309, filed Jul. 19, 2005, and 60/651,637, filed Feb. 11, 2005. The entire contents of the above mentioned applications are incorporated herein by this reference.

BACKGROUND OF THE INVENTION

1. Field of the Invention

The invention relates to connectors, and, more specifically, to a snap lock, RF connector.

2. Discussion of the Background

There is a need for electrical connectors that can be used in applications requiring RF or high-speed digital electrical signals.

SUMMARY OF THE INVENTION

In one aspect, the present invention provides a connector apparatus that can be used in, among other applications, applications requiring RF or high-speed digital electrical signals.

In one embodiment, the connector apparatus includes (1) a socket, comprising: a housing; an insulator disposed within the housing; a first contact disposed within the insulator; a ground contact housed within the housing; a lock ring disposed about a distal end of the housing; a shroud disposed about the distal end of the housing and the lock ring and moveable relative to the housing between a first position and a second position, the shroud having an outer wall and an inner wall, wherein, as the shroud moves from the first position to the second position, the inner wall contacts the lock ring and causes the lock ring to flex outwardly; and (2) a plug comprising: a generally cylindrical, conductive plug housing that houses an insulator and a contact disposed within the insulator, wherein, on its outer wall, the housing has a protuberance having a first sloping surface on one side thereof and a second sloping surface on an opposite side thereof, wherein, the socket is configured such that when the plug is inserted into the distal end of the socket and locked in place by the lock ring, the lock ring exerts an axial force on the protuberance of the plug housing, but the axial force does not cause the front surface of the plug housing to press against any surface of the socket.

In another aspect, the present invention provides a socket for use in a connector apparatus. In one embodiment, the socket includes: a housing; an insulator disposed within the housing; a first contact disposed within the insulator; an annular ground contact housed within an annular groove located in an inner surface of the housing; a lock ring disposed about a distal end of the housing; a shroud disposed about the distal end of the housing and the lock ring and moveable relative to the housing between a first position and a second position, the shroud having an outer wall and an inner wall. In a preferred embodiment, the shroud and the lock ring are configured so that when the shroud moves from the first position to the second position, the inner wall contacts the lock ring and causes the lock ring to flex outwardly.

In another aspect, the present invention provides a ground contact for use in establishing an electrical connection between a socket housing and a plug housing. In one embodiment, the ground contact includes: a first split ring; a second split ring; and one or more generally U shaped contacts connecting the first split ring with the second split ring, wherein the split rings are arranged so that they are coaxial.

The above and other features and advantages of the various aspects of the present invention, as well as the structure and operation of preferred embodiments, are described in detail below with reference to the accompanying drawings.

BRIEF DESCRIPTION OF THE DRAWINGS

The accompanying drawings, which are incorporated herein and form part of the specification, help illustrate various embodiments of the present invention and, together with the description, further serve to explain the principles of the invention and to enable a person skilled in the pertinent art to make and use embodiments of the invention. In the drawings, like reference numbers indicate identical or functionally similar elements.

DETAILED DESCRIPTION OF PREFERRED EMBODIMENTS

Figure 1:
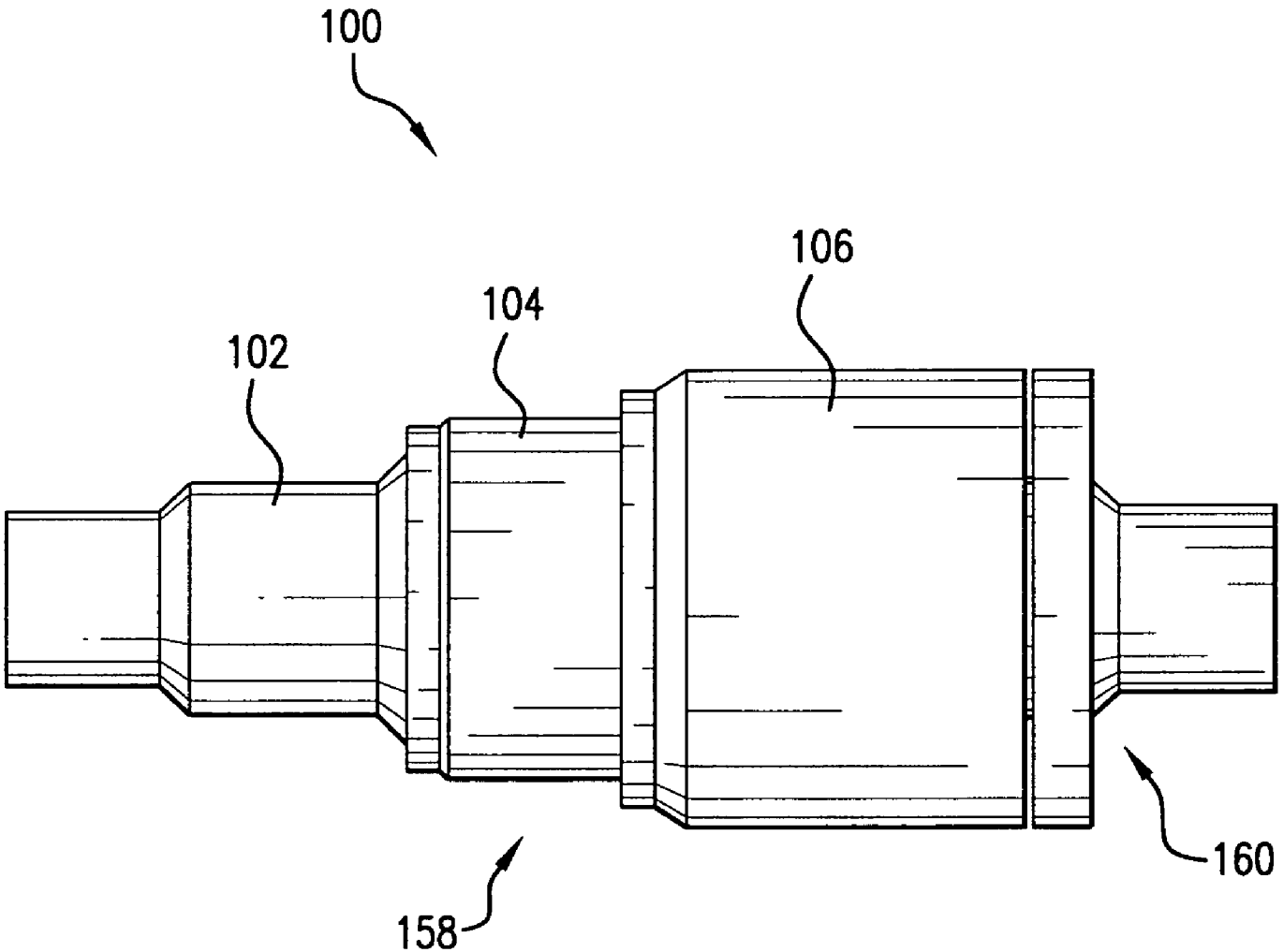
FIGS. 1 and 19-20 illustrates a connector assembly according to an embodiment.

FIG. 1 is a side view of a snap lock connector apparatus 100 according to an embodiment of the present invention. Connector apparatus 100 includes a first connector component 158 (a.k.a., "socket component 158") and a second connector component 160 (a.k.a., "plug 160"). Preferably, socket 158 is designed to receive plug 160, as shown in FIG. 1. As further shown in FIG. 1, socket 158 may include a first housing 102, a second housing 104 and a shroud 106.

Figure 2:
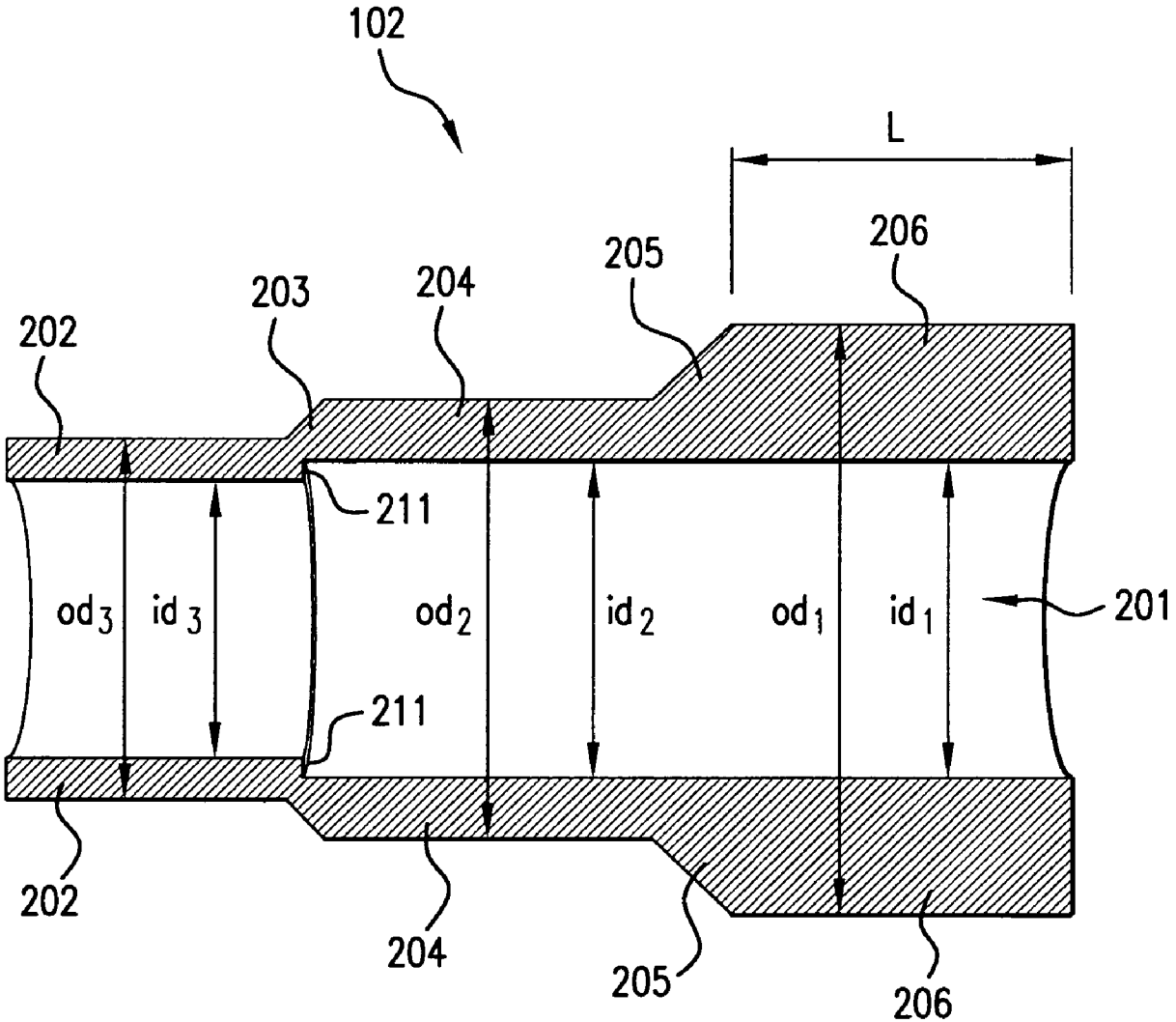
FIGS. 2-3 illustrate a first housing of a socket according to an embodiment.

Referring now to FIG. 2, FIG. 2 is a cross-sectional, side view of first housing 102, according to one embodiment. As shown, housing 102 may be generally cylindrical and define a cavity 201. Housing 102 may also have a first end section 202, a second end section 206, and an interim section 204 located between end sections 202 and 206. Each section 202, 204 and 206 may have an outer-diameter and an inner-diameter. These inner and outer diameters may be uniform.

Preferably, the outer-diameter (od1) of end section 206 is greater than the outer-diameter (od2) of interim section 204. Additionally, the outer-diameter (od2) of interim section 204 may be greater than the outer-diameter (od3) of end section 202. Further, the inner-diameter (id1) of end section 206 may be equal to the inner-diameter (id2) of interim section 204, and the inner-diameter (id2) of interim section 204 may be greater than the inner-diameter (id3) of end section 202, thereby forming an inner wall 211.

Preferably, there is provided a conical transition section 205 located between interim section 204 and end section 206. There may also be provided a conical transition section 203 between end section 202 and interim section 204. Transition section 205 has a non-uniform outer-diameter. As shown in FIG. 2, at its largest, the outer-diameter of section 205 is equal or about equal to od1, and, at its smallest, the outer-diameter of section 205 is equal or about equal to od2.

Figure 3:
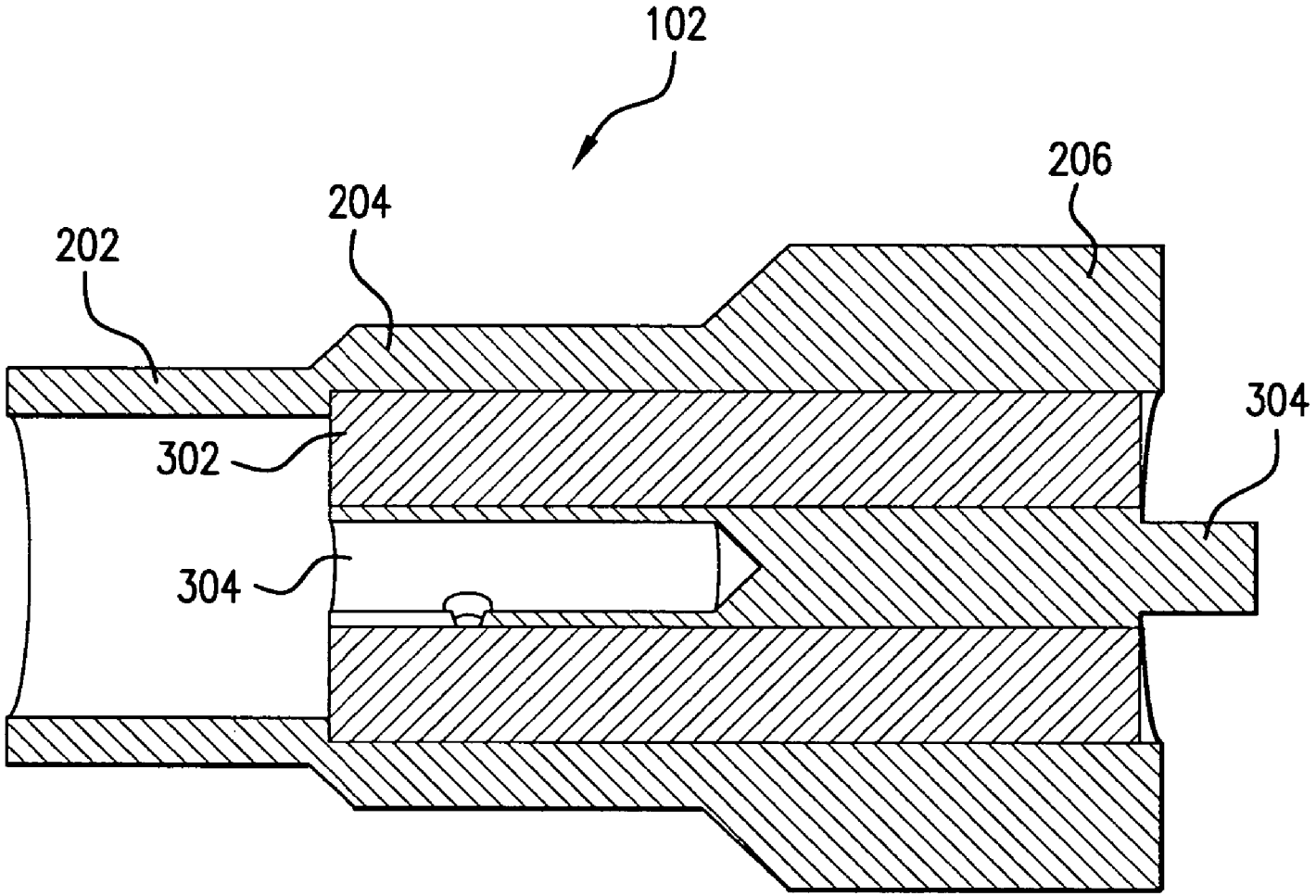

Referring now to FIG. 3, FIG. 3 illustrates a dielectric body 302 and contact 204 housed in the cavity 201 of housing 102. In the embodiment shown, contact 204 is elongate and has a longitudinal axis that is aligned with the longitudinal axis of dielectric body 302 and the longitudinal axis of housing 102. Dielectric body 302 surrounds at least a portion of contact 304 and functions to electrically insulate contact from housing 104, which is electrically conductive.

Figure 4:
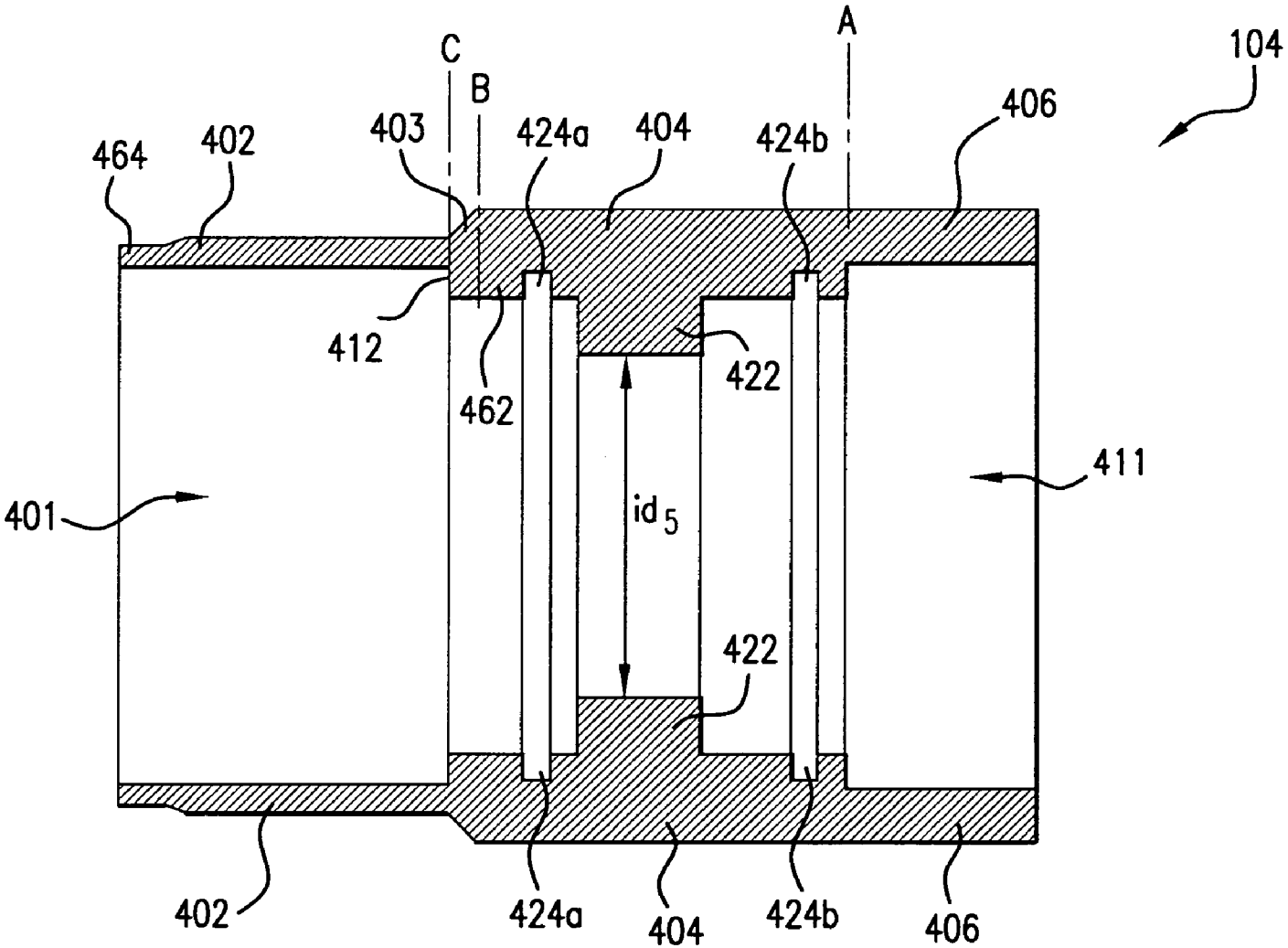
FIGS. 4-7 illustrate a second housing of the socket according to an embodiment.
Figure 5:
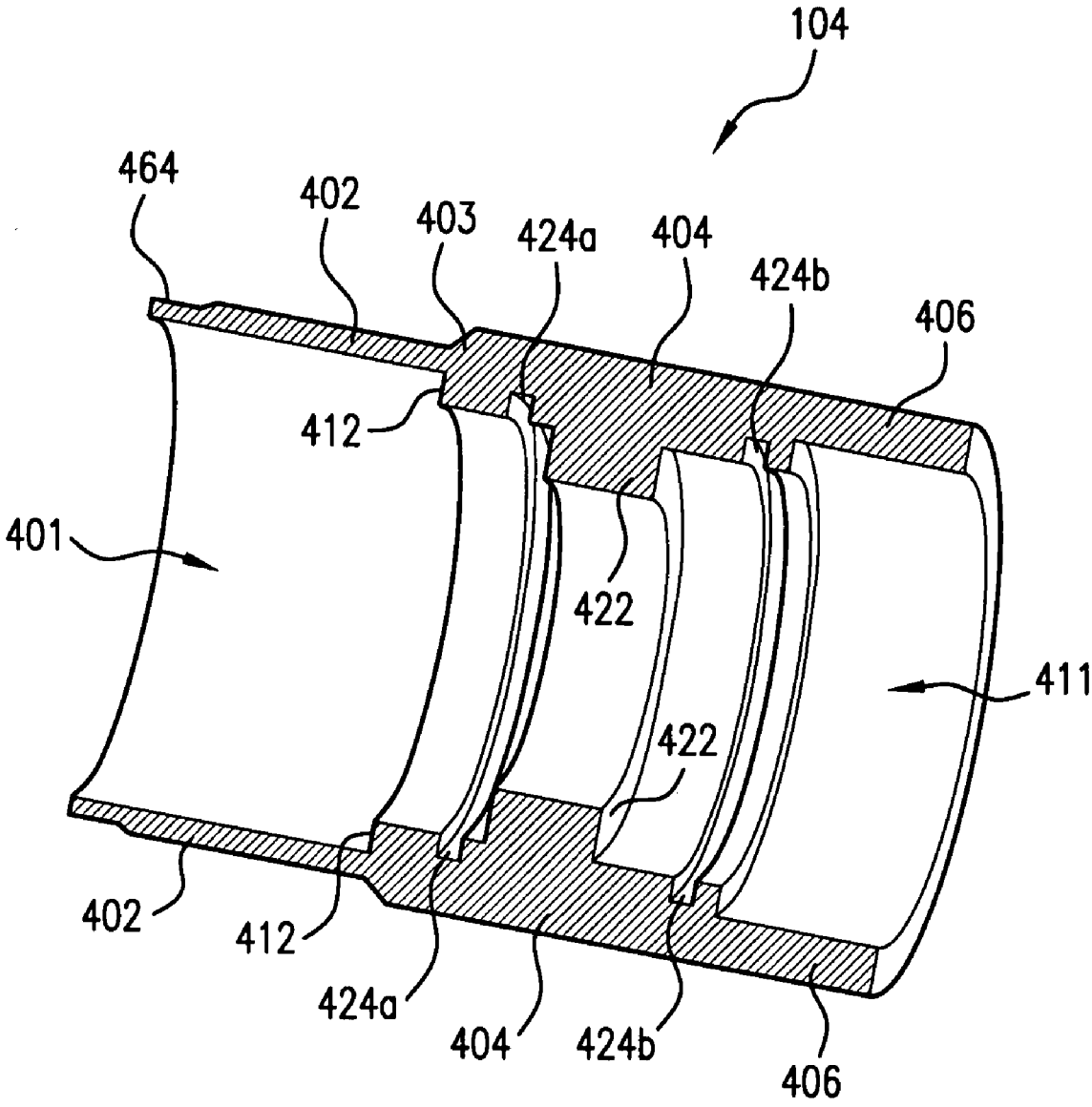

Referring now to FIGS. 4 and 5, FIG. 4 is a cross-sectional, side view of second housing 104 and FIG. 5 is a cross-sectional, perspective view of second housing 104, both views according to one embodiment. As shown, housing 104 may be generally cylindrical. Housing 104 may also have a first end section 402 (i.e., the section to the left of dotted line C), a second end section 406 (i.e., the section to the right of dotted line A), and an interim section 404 located between end sections 402 and 406 (i.e., the section between dotted lines B and C). Each section 402, 404 and 406 may have an outer-diameter and an inner-diameter and define a cavity. For example, end section 402 defines a cavity 401 and end section 406 defines cavity 411.

Preferably, there is provided a transition section 403 between end section 402 and interim section 404. Transition section 403 has a non-uniform outer-diameter. As shown in FIG. 4, at its largest, the outer-diameter of section 403 is equal or about equal to the outer-diameter of section 404, and, at its smallest, the outer-diameter of section 403 is equal or about equal to the outer-diameter of section 402.

As shown in FIGS. 4 and 5, interim section 404 may include an inwardly projecting annular rib 422. Additionally, a first recess 424*a* and a second recess 424*b*, both of which may be annular, may be formed in an inner surface 462 of interim section 404. First recess 424*a* may be located between rib 322 and interim section 403. Second recess 424*b* may be located between rib 322 and end section 406.

Figure 6:
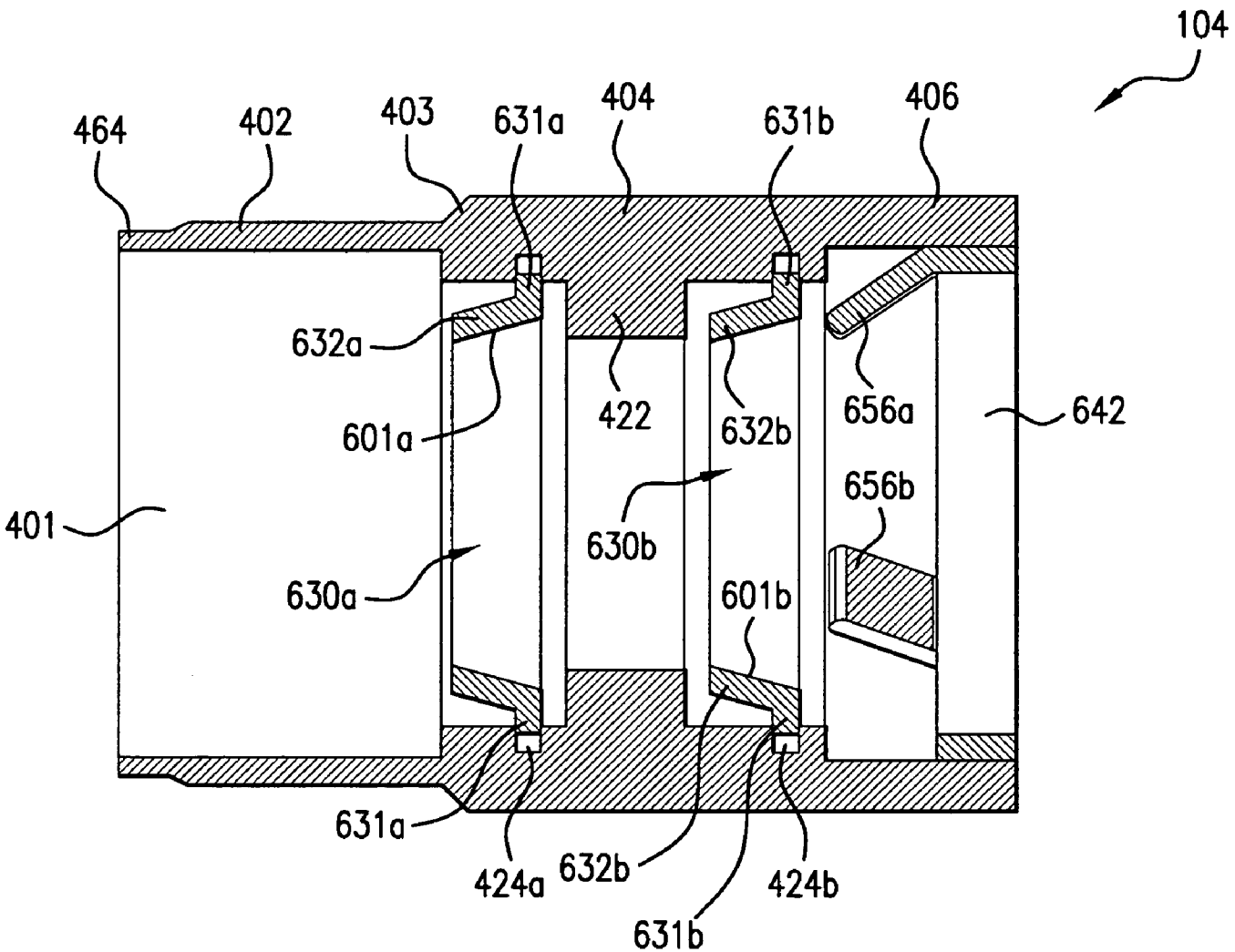
Figure 7:
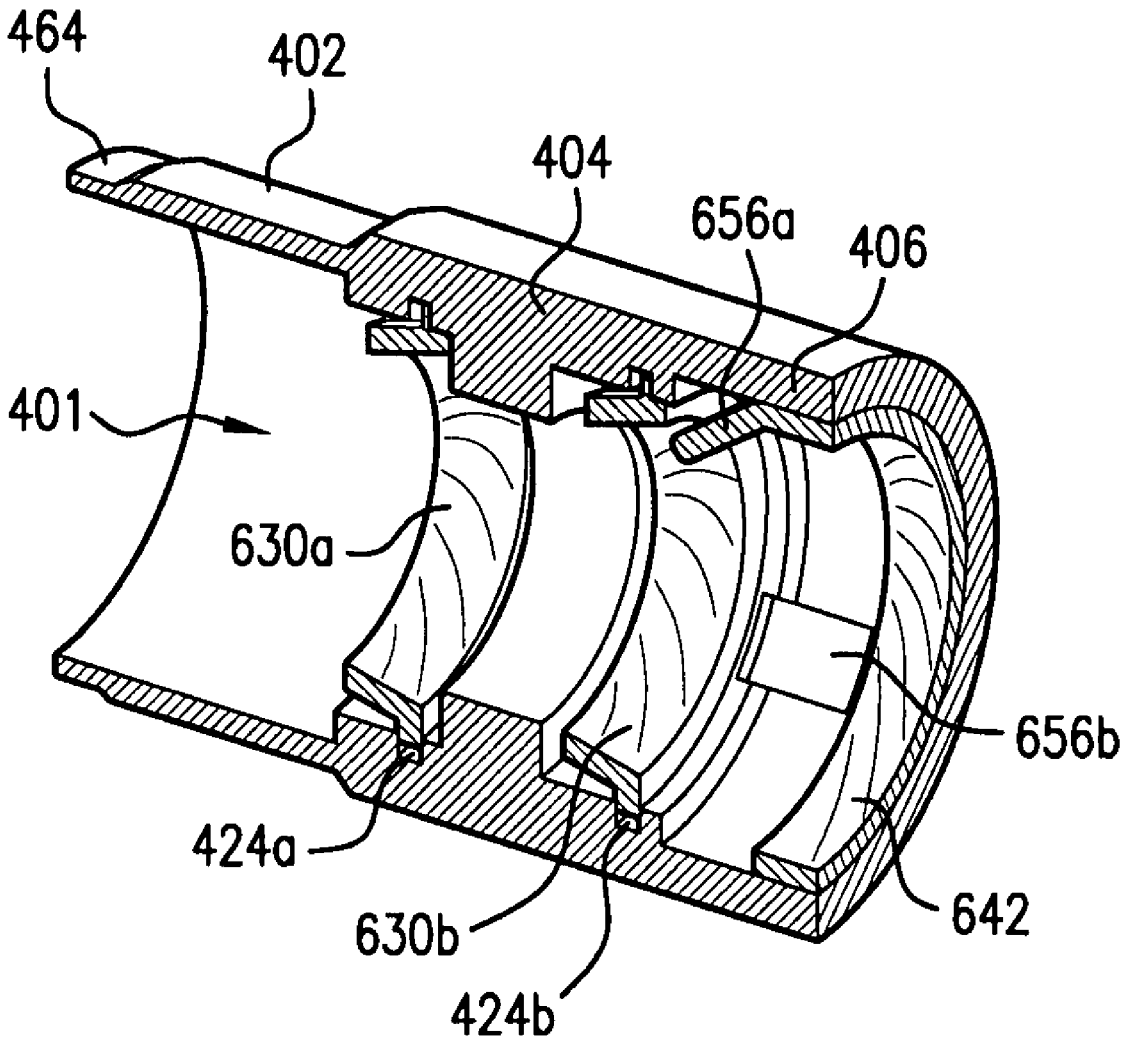

Referring now to FIGS. 6 and 7, FIGS. 6 and 7 illustrate two conductive ground contacts 630*a* and 630*b* and a lock ring 642 housed in housing 104. Ground contact 630, according to one embodiment, is further illustrated in FIGS. 8 and 9.

Figure 8:
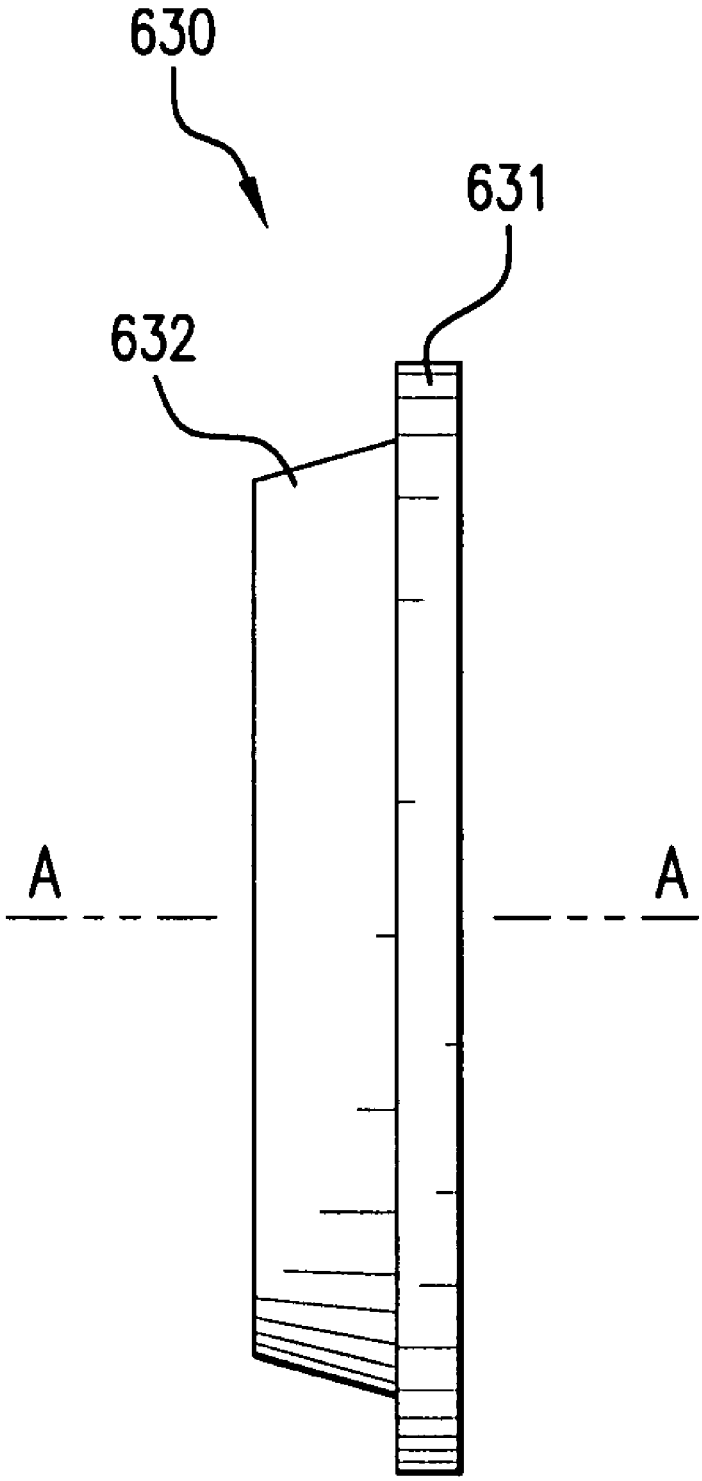
FIGS. 8-9 illustrate a ground contact according to an embodiment.
Figure 9:
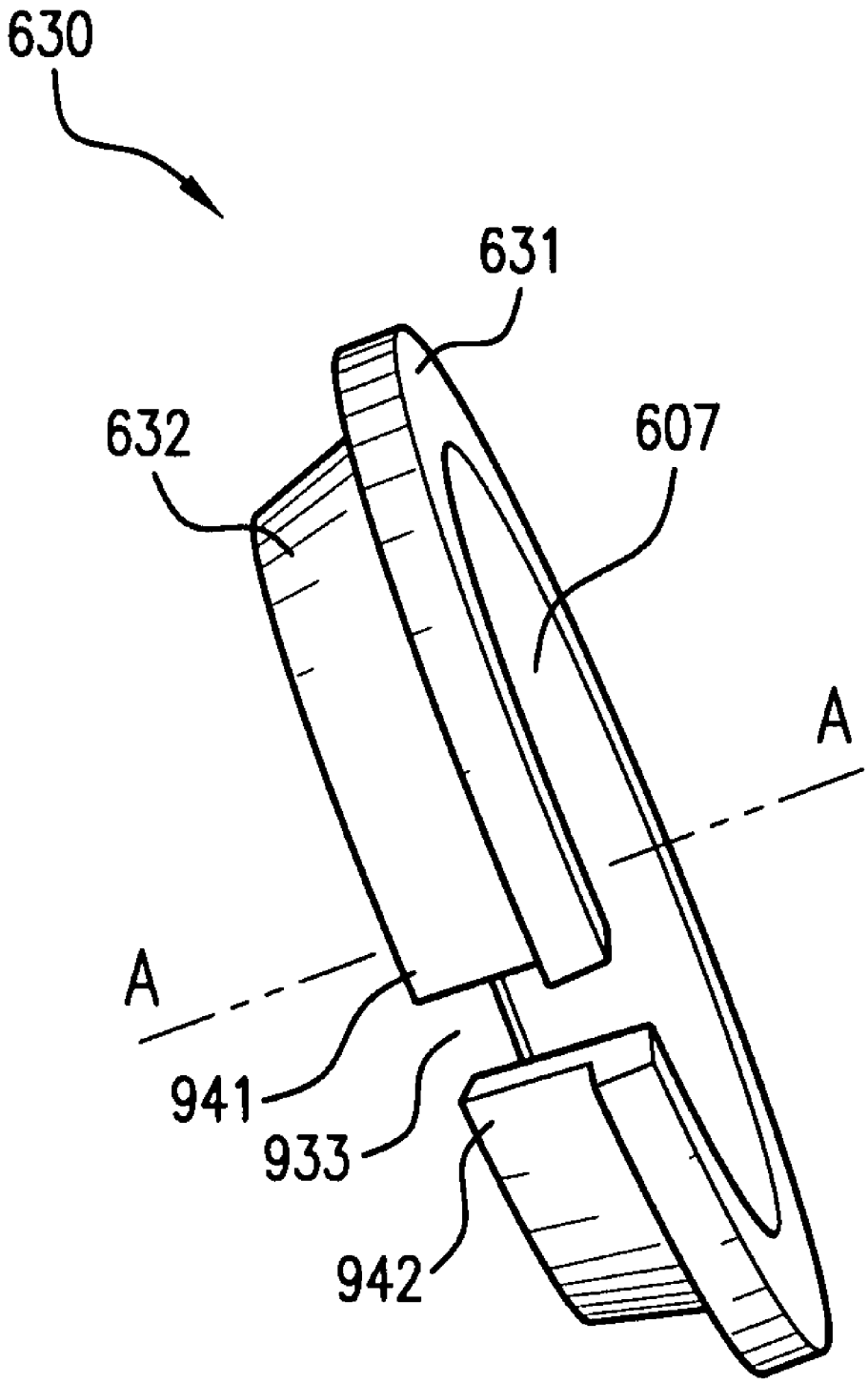

FIG. 8 is a side view of ground contact 630 and FIG. 9 is a perspective view of ground contact, both according to one embodiment. As shown, ground contact may be generally ring shaped and have a body section 632 and a flange section 631 connected to body section 632 and projecting outwardly from an outer surface of body section 632. Preferably, body section 632 is generally conical (e.g., the outer and inner diameter of body portion 632 gradually increases/decreases as one moves from one side of body section to the other side). Flange section 631 may be disposed so that it projects outwardly from a portion of body section 632 where the outer-diameter is the greatest.

Referring now to FIG. 9, FIG. 9 illustrates that ground contact 630 may not form a complete ring. That is, ground contact has two ends 941, 942 that generally face each other, but are separated by a small space or slit 933. Thus, ground contact 630 may be referred to as a "split ring contact."

Referring back to FIGS. 6 and 7, the flange section of ground contact 630 is received in recess 424. More specifically, flange 631*a* of ground contact 630*a* is received in recess 424*a* and flange 631*b* of ground contact 630*b* is received in recess 424*b*. Preferably, flange 631 fits tightly in recess 424 so that when flange 631 is inserted into recess 424 the ground contact will be generally fixed in position. As shown, ground contacts 630*a,b* are both positioned in housing 104 so that the wider side of the ground contact 630 is closer to end section 406 than the narrow side.

As shown in FIGS. 6 and 7, lock ring 642, or a portion thereon, may be disposed within the cavity 411 formed by end section 406 of housing 404. Preferably, lock ring 642 is fastened to housing 404 so that it can not move relative to housing 104 in a direction parallel to the longitudinal axis of housing 104 unless a relatively large force is applied to the lock ring in that direction. For example, an adhesive or other fastener may be used to fasten lock ring 642 to housing 104.

In one embodiment, lock ring 642 includes a cylindrical or conical ring with one or more elastic locking arms 656 projecting from a side of the ring. Preferably, in embodiments where there is more than one arm 656, the arms 656 arranged at regular angular intervals around the rings circumference.

Figure 10:
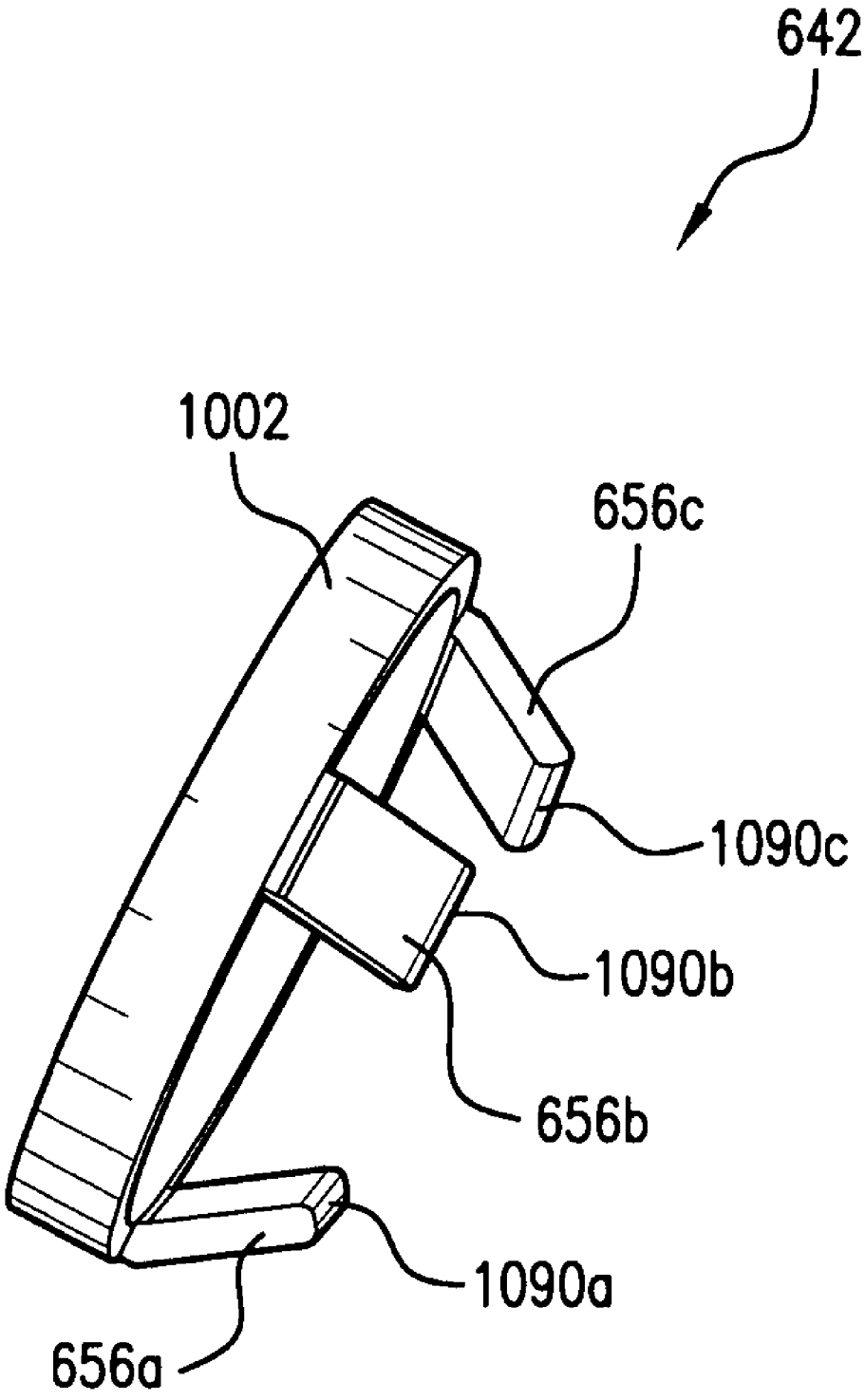
FIGS. 10-11 illustrate a lock ring according to an embodiment.
Figure 11:
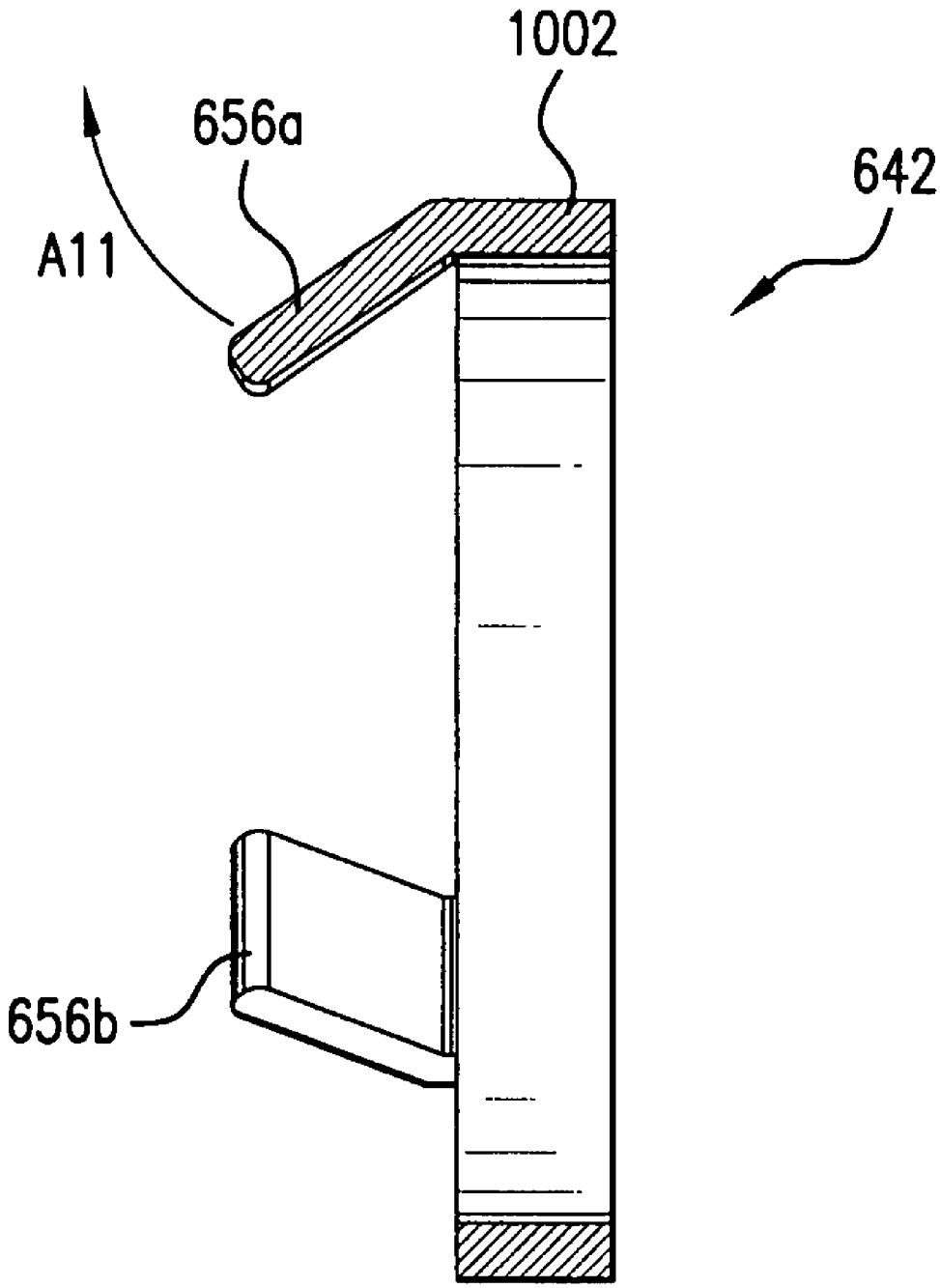

FIGS. 10 and 11 illustrate an embodiment of lock ring 642 in which lock ring 642 has three arms 656 (a.k.a., prongs 656) projecting from a ring 1002. FIG. 10 is a perspective view of lock ring 642, and FIG. 11 is a cross-sectional, side view of lock ring 642. As shown in FIGS. 10 and 11, the prongs 656 project outwardly from generally one side of ring 1002 and are angled inwardly towards the center of the ring. As further described herein, lock ring 642 functions to "lock" plug 160 in place when plug 160 is inserted into socket 158.

Figure 12:
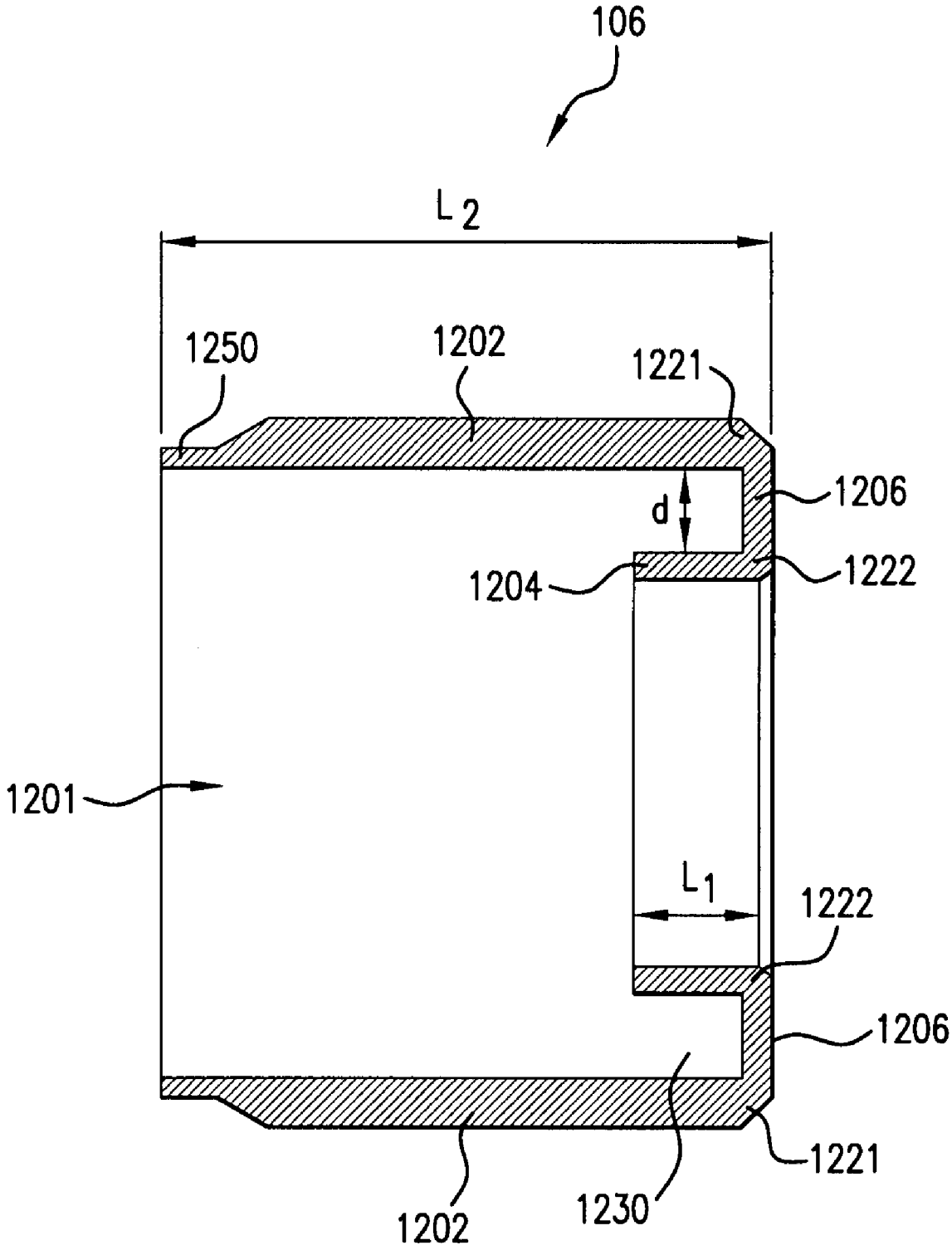
FIGS. 12-13 illustrate a shroud according to an embodiment.
Figure 13:
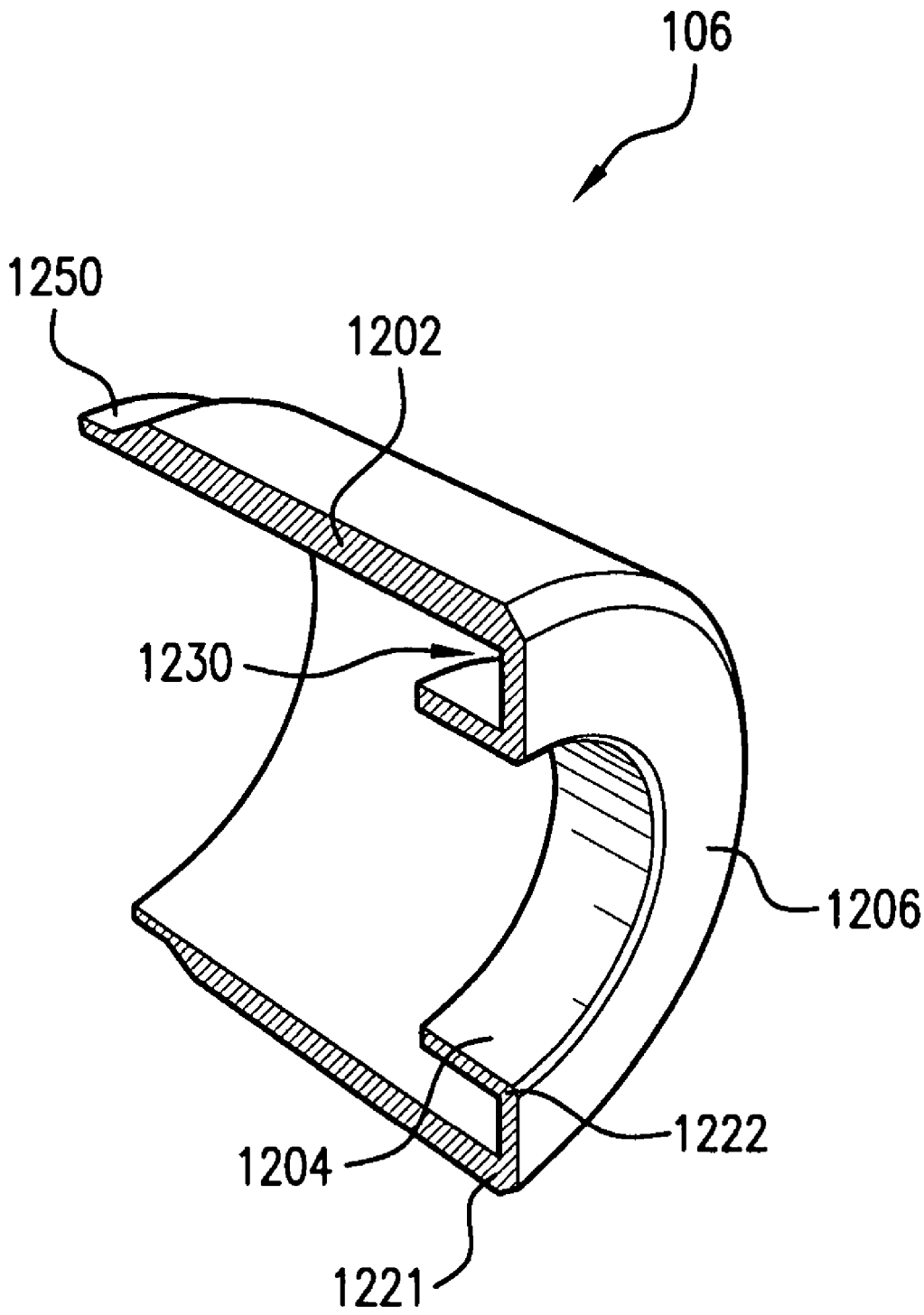

Referring now to FIGS. 12 and 13, FIG. 12 is a cross-sectional, side view of shroud 106 and FIG. 13 is a cross-sectional, perspective view of shroud 106, both views according to one embodiment. As shown, shroud 106 may have an outer wall 1202, an inner wall 1204, and a connecting wall 1206 connecting the inner wall 1204 to the outer wall 1202. In the embodiment shown walls 1202, 1204 and 1206 are each in the form of a ring. In this embodiment, outer ring wall 1202 encloses a space 1201 and inner ring wall 1204 is disposed in space 1201 and is coaxial with outer ring wall 1202. Further, connecting wall 1206 is connected between an end 1221 of wall 1202 and an end 1222 of wall 1204. Walls 1202, 1204, and 1206 define a space 1230. Preferably, the length (11) of inner wall 1204 is significantly less than the length (12) of outer wall 1204.

Figure 14:
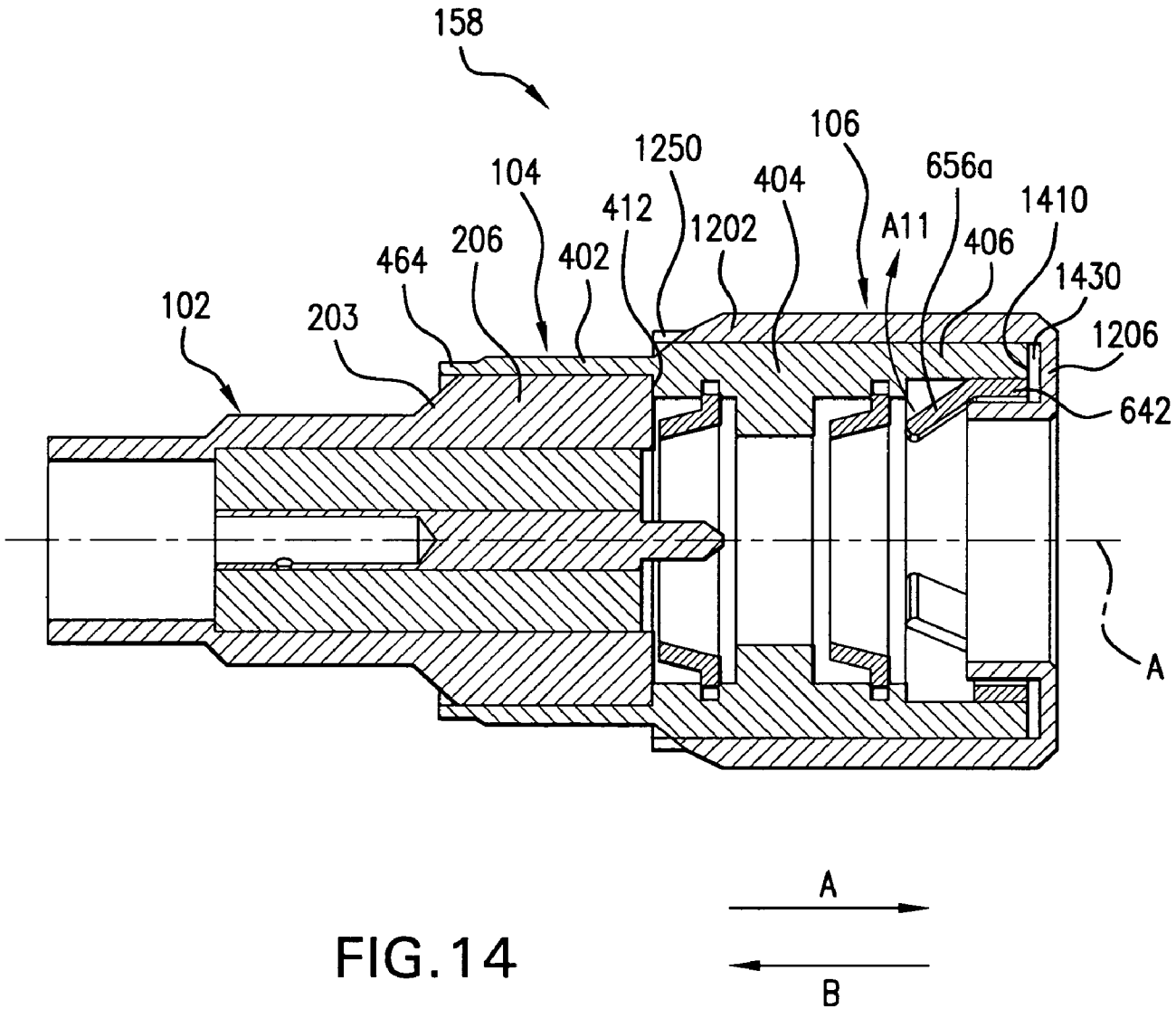
FIGS. 14-15 illustrate a socket according to an embodiment.
Figure 15:
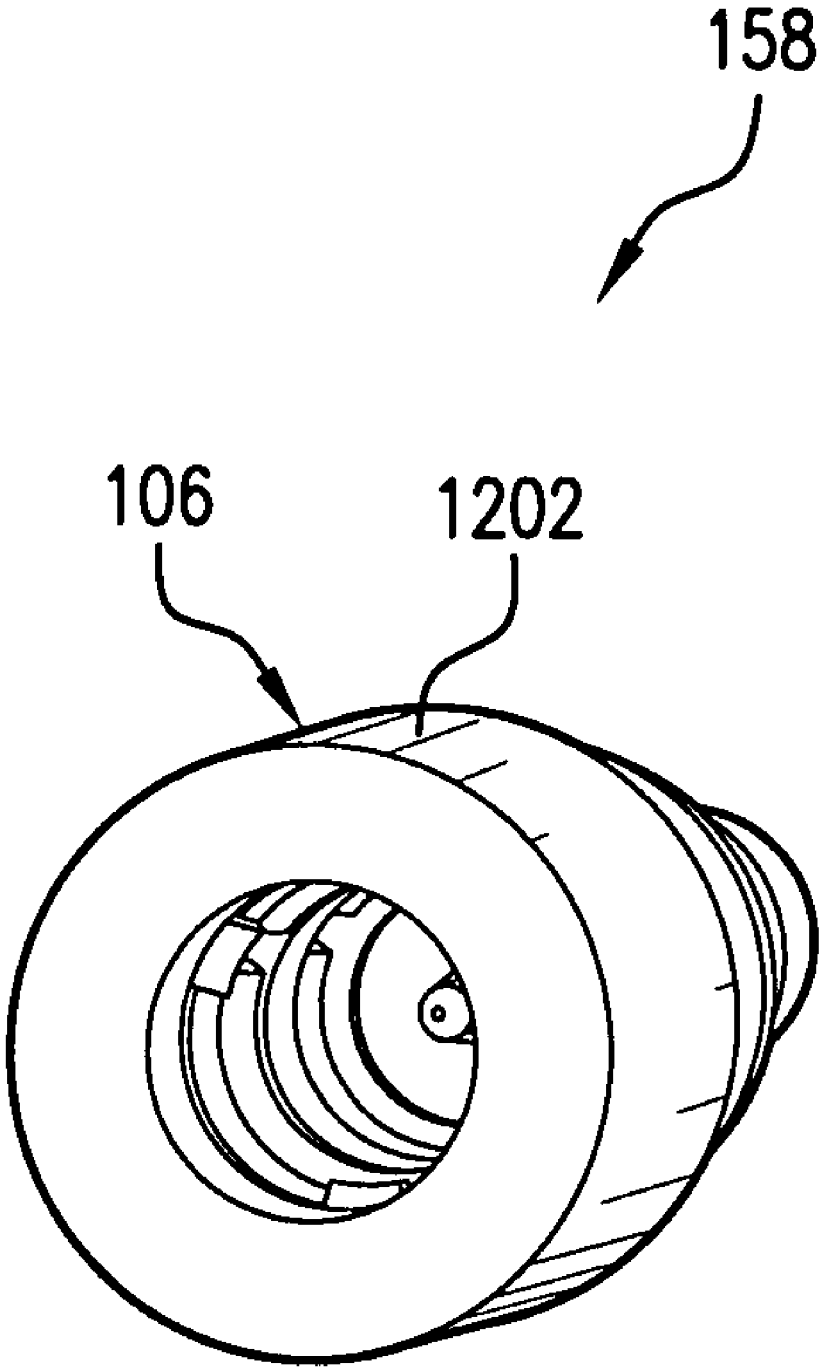

Referring now to FIGS. 14 and 15, FIG. 14 is a cross-sectional, side view of socket 158 and FIG. 15 is a perspective view of socket 158, both views according to one embodiment. As shown, end section 206 of first housing 102 is disposed within cavity 401 such that end section 206 abuts wall 412. Accordingly, at least a portion of first housing 102 is housed within second housing 104.

Preferably, the distance from wall 412 to end 464 of section 402 of housing 104 is greater than the length of end section 206 of housing 102 such that end 464 overhangs at least a portion of transition section 203 of housing 102. To prevent end section 206 from being removed from cavity 401, end 464 of may be bent downwardly towards housing 102.

As further shown in FIG. 14, at least a portion of second housing 104 is disposed within cavity 1201 formed by wall 1202. For example, end section 406 and interim section 404 of second housing are disposed in cavity 1201. Additionally, at least a portion of end section 406 and lock ring 642 are disposed in the space 1230 formed by walls 1202, 1204 and 1206 of shroud 106. However, preferably, the projecting arms 656 are not disposed in space 1230.

Additionally, it is preferred that shroud 106 be fixed to housing 104. Shroud 106 may be fixed to housing 104 by inserting end section 406 and interim section 404 of second housing into cavity 1201 as shown in FIG. 14, and then folding down end portion 1250 of wall 1202 so that when shroud 106 is moved relative to housing 104 in the direction of arrow A, folded over end portion 1250 eventually contacts a surface of interim section 403, thereby preventing further movement of shroud 106 relative to housing 104.

Preferably, shroud 106 is fixed to housing 104 in such a way that shroud 106 can move in a direction parallel to the longitudinal axis A of socket 158 between an "unlocked" and a "locked" position. In the locked position, there is a gap 1430 between wall 1206 and the end 1420 of end section 406 of housing 104, and in the unlocked position the gap 1430 is either reduced or removed completely so that end 1420 abuts wall 1206.

More specifically, in the unlocked position wall 1204 contacts arm 656 and exerts a force on arm 656 that causes arm 656 to flex outwardly. For example, with respect to arm 656*a*, in the unlocked position, wall 1204 contacts arm 656*a* and exerts a force thereon that causes arm 656*a* to flex outwardly in the direction of arrow A11 (see FIGS. 11 and 14). If no external forces act on shroud 106 when shroud 106 is in an unlocked position, shroud 106 will automatically return to the locked position because, due to the elasticity of arm 656, arm 656 exerts a force on wall 1204 in the direction of arrow A (see FIG. 14), which force will cause the entire shroud 106 to move in the direction of arrow A and into the locked position.

Figure 16:
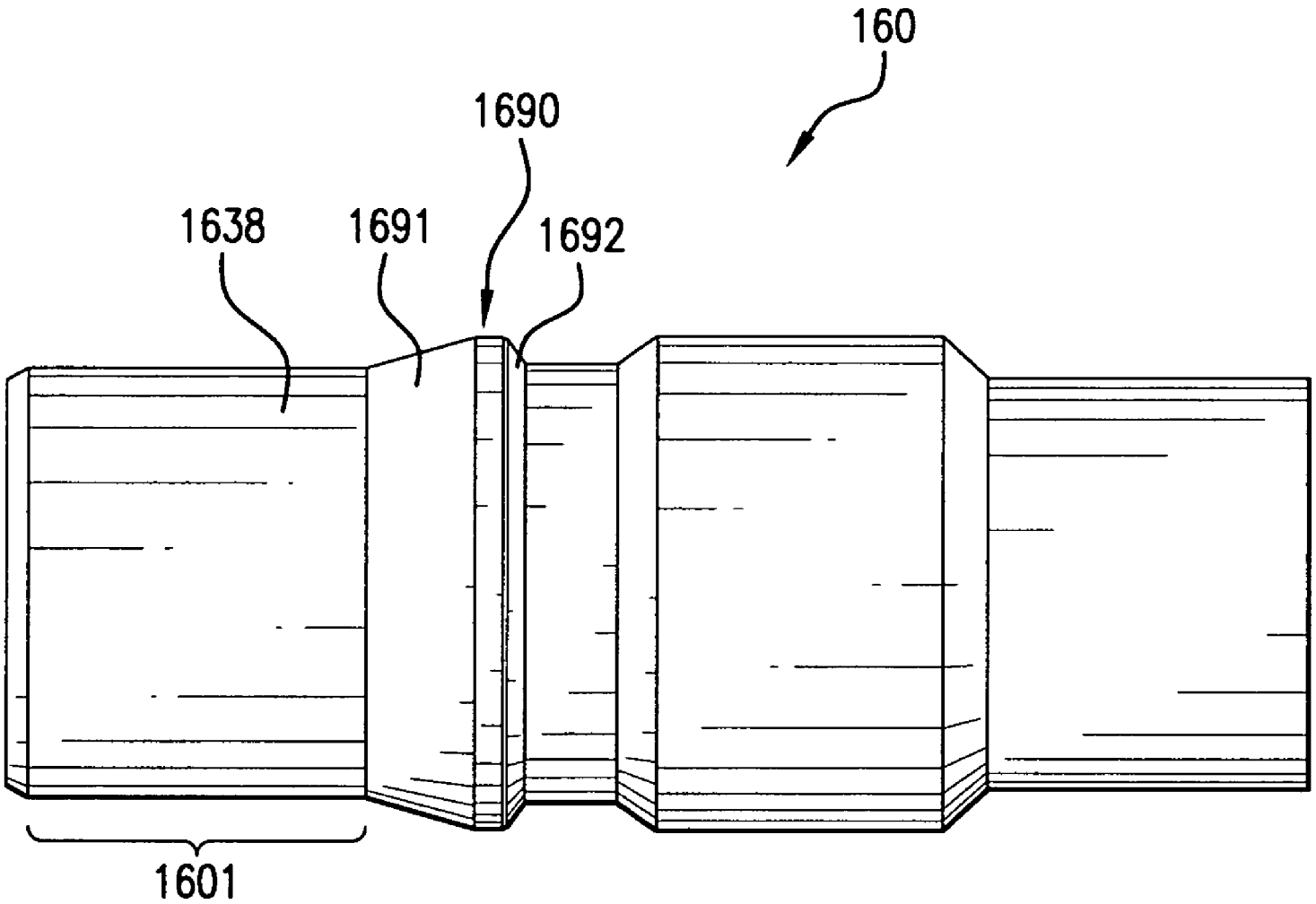
FIGS. 16-18 illustrate a plug according to an embodiment.
Figure 17:
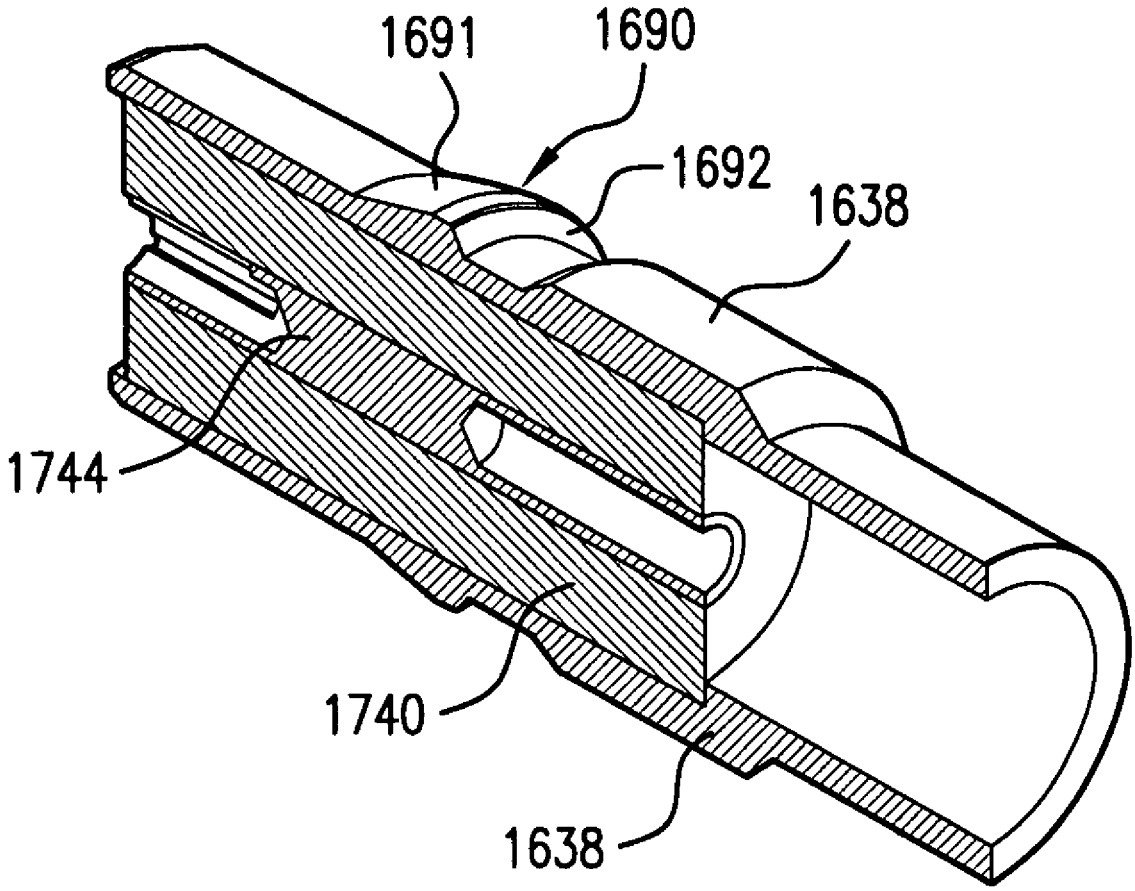
Figure 18:
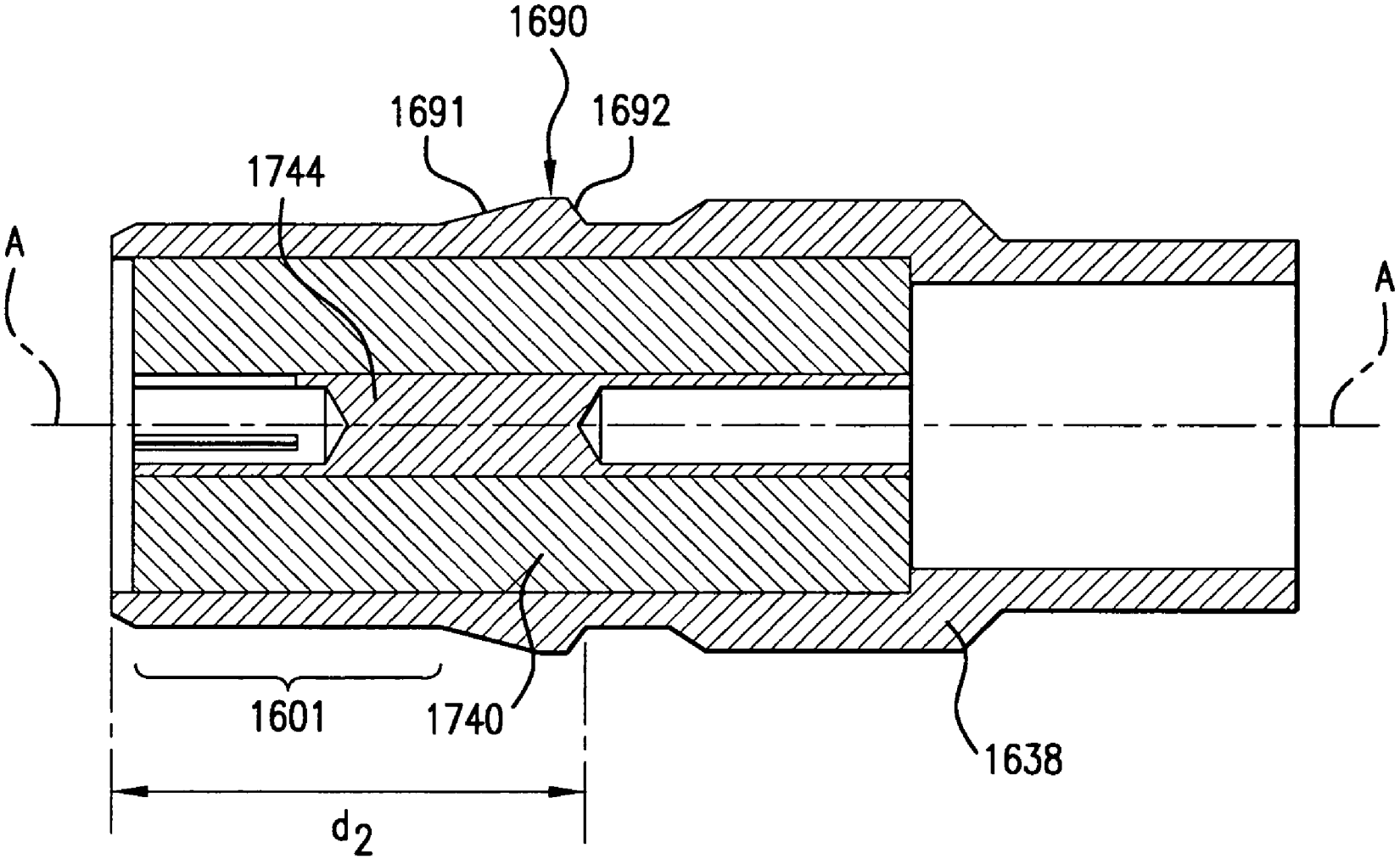

Referring now to FIGS. 16-18, FIG. 16 is a side view of plug 160, FIG. 17 is a cross-sectional, perspective view of plug 160 and FIG. 10 is a cross-sectional, side view of plug 160, all according to one embodiment.

In one embodiment, shown in FIGS. 16-18, plug 160 includes a generally cylindrical, conductive plug housing 1638. In one embodiment, shown in FIGS. 17-18, plug housing 1638 houses an insulator 1740, and a contact 1744, which may be male and/or female, is disposed fixedly within insulator 1740.

On its outer wall, housing 1638 preferably has a protuberance 1690 having a first sloping surface 1691 on one side thereof and a second sloping surface 1692 on an opposite side thereof. Protuberance 1690 may be disposed axially about housing 1638. As further described below, protuberance 1690 functions with lock ring 642 to retain plug 160 in socket 158 after plug 160 has been fully inserted into socket 158.

Figure 19:
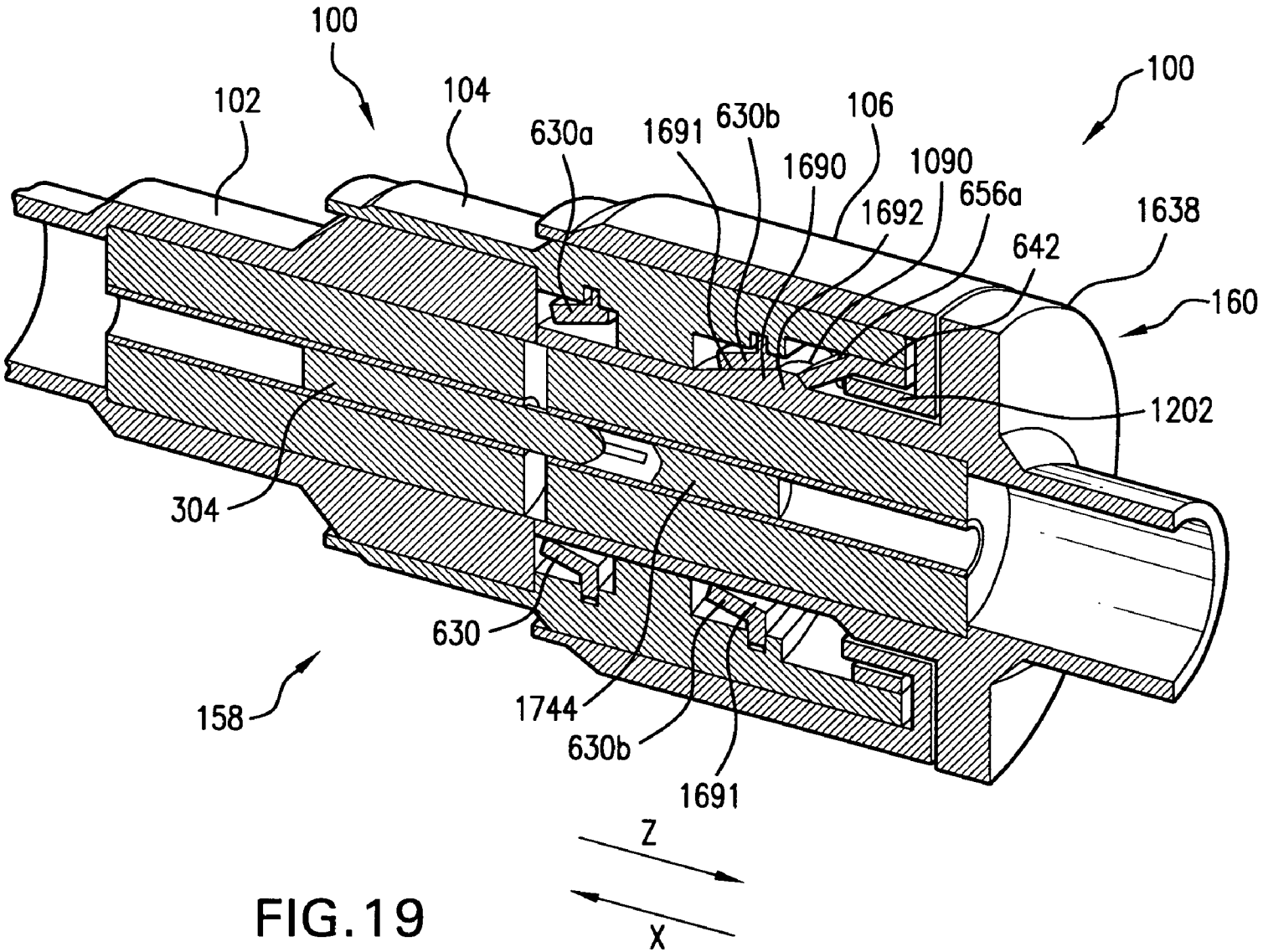
Figure 20:
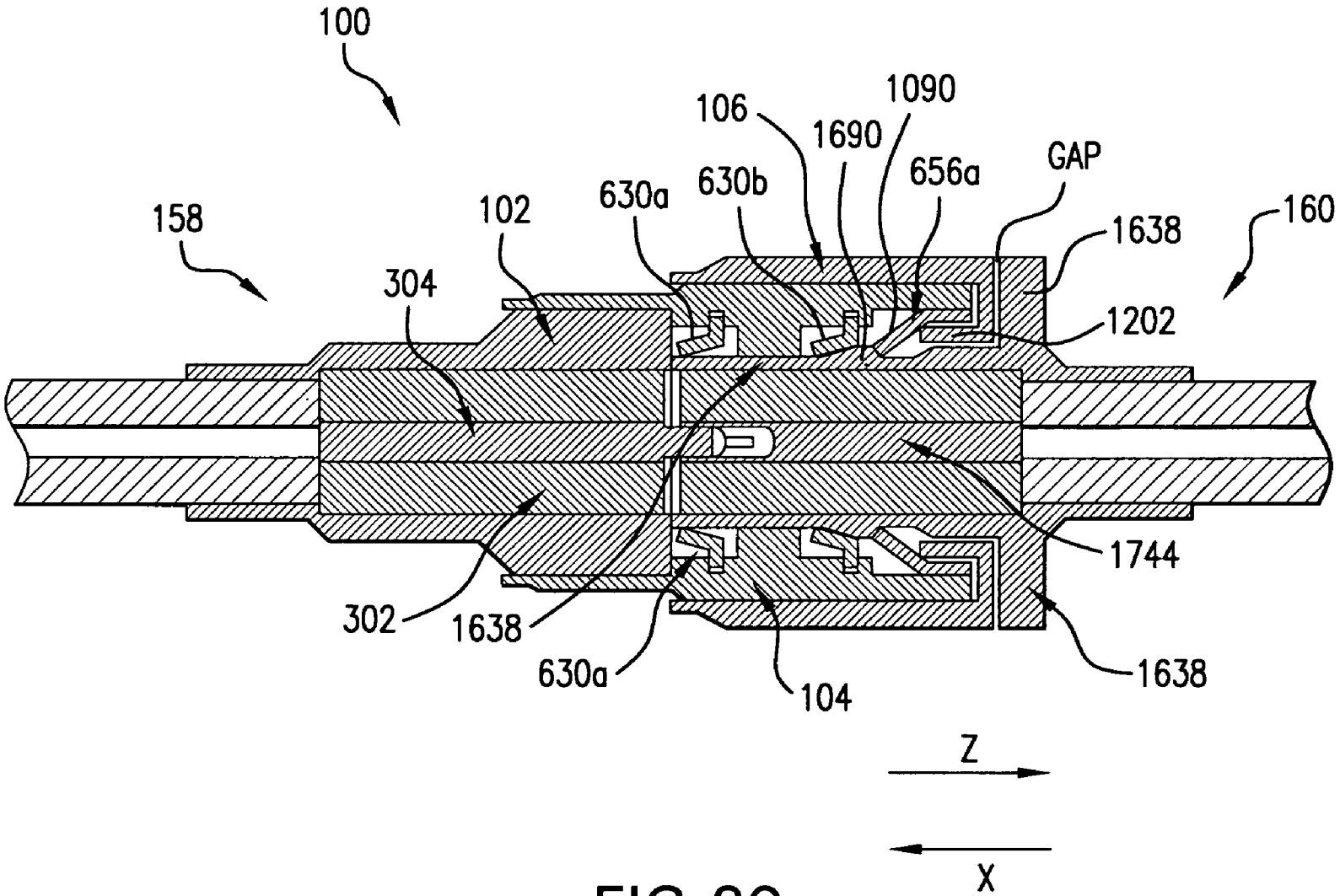

Referring now to FIGS. 19 and 20, FIGS. 19 and 20 show plug 160 fully inserted into socket 158, according to an embodiment. In one embodiment, as shown in FIGS. 19 and 20, when plug 160 is fully inserted into socket 158, plug contact 1744 conductively mates with socket contact 304. In the embodiment shown, plug contact 1744 is a female contact while socket contact 304 is a male contact. In an alternative embodiment, plug contact 1644 is a female connector while socket contact 310 is a male connector. Additionally, protuberance 1690 and lock ring 642 cooperate to "lock" plug 160 inside of socket 158. That is, protuberance 1690 and lock ring 642 prevent contacts 304 and 1744 from becoming unmated because protuberance 1690 and lock ring 642 limit plug 160's movement in the direction of arrow Z (see FIG. 20).

In the embodiment shown, when plug 160 is inserted into socket 158, the sloping surface 1691 of protuberance 1690 is the first portion of protuberance 1690 to contact projecting arm 656 of lock ring 642. Because arm 656 is somewhat elastic, when plug 160 is pushed into socket 158, sloping surface 1691 urges arm 656 to move outwardly allowing protuberance 1690 to pass under arm 656. Once protuberance 1690 has passed under arm 656, the arm 656 automatically moves back to its original position, as shown in FIGS. 19 and 20.

When arm 656 returns to its original positions, an end 1090 of arm 656 is positioned opposite of surface 1692 of protuberance 1690. Thus, if one attempts to move plug 160 relative to socket 158 in the direction of arrow Z, surface 1692 will contact end 1090 of arm 656 and exert a force on arm 656 in the direction of arrow Z. Arm 656 is connected to band 1002 and band 1002 is fixed to housing 104, which is fixed to housing 102. Thus, arm 656 is not free to move in the direction of arrow Z relative to housing 104. Accordingly, arm 656 will exert an equal and opposite force on surface 1692, thereby preventing plug 160 from moving relative to socket 150 in the direction of arrow Z. Preferably, surface 1692 is angled with respect to outer surface of housing 1638 such that, when surface 1692 exerts forces on arm 656, arm 656 is not urged outwardly.

To remove plug 160 from socket 158, one moves shroud 106 from its steady state "locking" position to an "unlocked" position. To move shroud to the unlocked position, shroud 106 is moved relative to housing 104*a* distance in the direction of arrow X (see FIGS. 19 and 20). The distance needs to be great enough so that wall 1202 contacts arm 656 (e.g., arm 656*a*) and urges arm 656 upwardly to an extent that protuberance 1690 can pass under arm 656. When shroud 106 is in its unlocked position, one can remove plug 160 from socket 150 by pulling on plug 160 in the Z direction.

Referring to FIGS. 19 and 20 and specifically to ground contacts 630, ground contacts 630 preferably are split ring ground contacts (see FIG. 9) and have an inner diameter that is smaller than an outer diameter of a front portion 1601 of plug housing 1638. Accordingly, in this embodiment, when plug 160 is inserted into socket 158, front portion 1601 contacts an inner surface 601 of the body portion 632 and exerts a radial force on body portion 632 that causes contact 630 to open (i.e., causes gap 933 to grow wider). Body portion 632 responds to this force by exerting a radial force on housing 1638. These forces between ground contacts 630 and conductive housing 1638 create a good electrical connection between contacts 630 and housing 1638.

In the embodiment shown, socket 158 and plug 160 are configured so that when plug 160 is fully inserted into socket 158 surface 1691 of housing 1638 is in contact with and exerts a radial and axial force on inner surface 601 of ground contact 630*b*, causing gap 933 to expand and causing contact 630*b* to exert a radial and axial force on housing 1638. The axial force exerted on housing 1638 by contact 630*b* is exerted in the direction of arrow Z.

Referring now to FIG. 19 and annular rib 422, plug housing 1638 may be disposed conductively within annular rib 422. In one embodiment, an inner diameter (id5) (see FIG. 4) of annular rib 422 may guide cylindrical plug housing 1638 during insertion into socket 158. In this embodiment, housing 1638 may be press fit inside annular rib 422. In another embodiment, housing 1638 may be slip fit inside rib 422.

ALTERNATIVE EMBODIMENT

Figure 21:
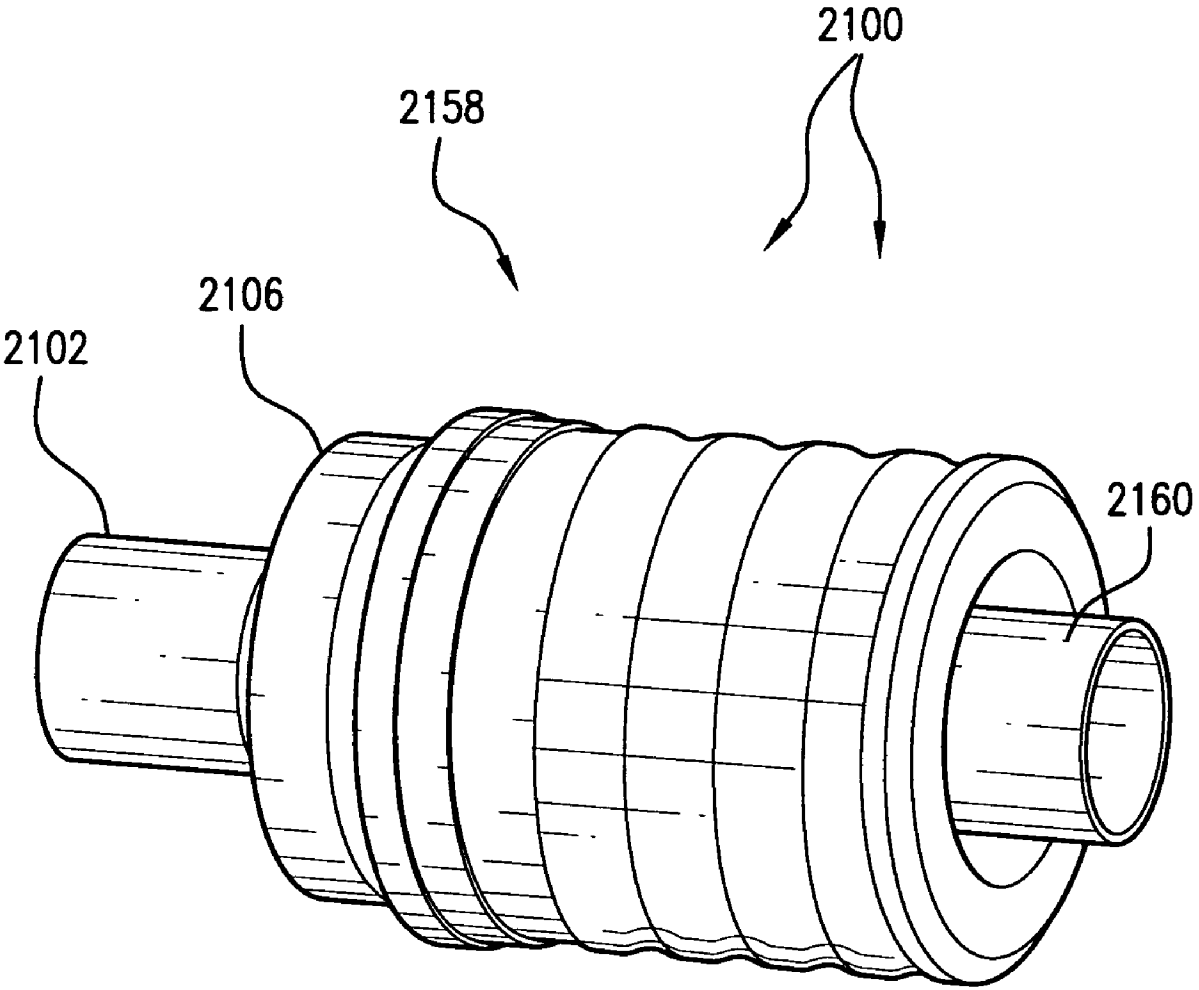
FIGS. 21-34 illustrate various components of another embodiment of the connector.

FIG. 21 is a side view of a snap lock connector apparatus 2100 according to another embodiment of the present invention. Connector apparatus 2100 includes a first connector component 2158 (a.k.a., "socket 2158") and second connector component 160 (a.k.a., "plug 160"). Preferably, socket 2158 is designed to receive plug 160, as shown in FIG. 21. As further shown in FIG. 21, socket 2158 may include a housing 2102 (a.k.a., "socket body 2102" or "body 2102") and a shroud 2106.

Figure 22:
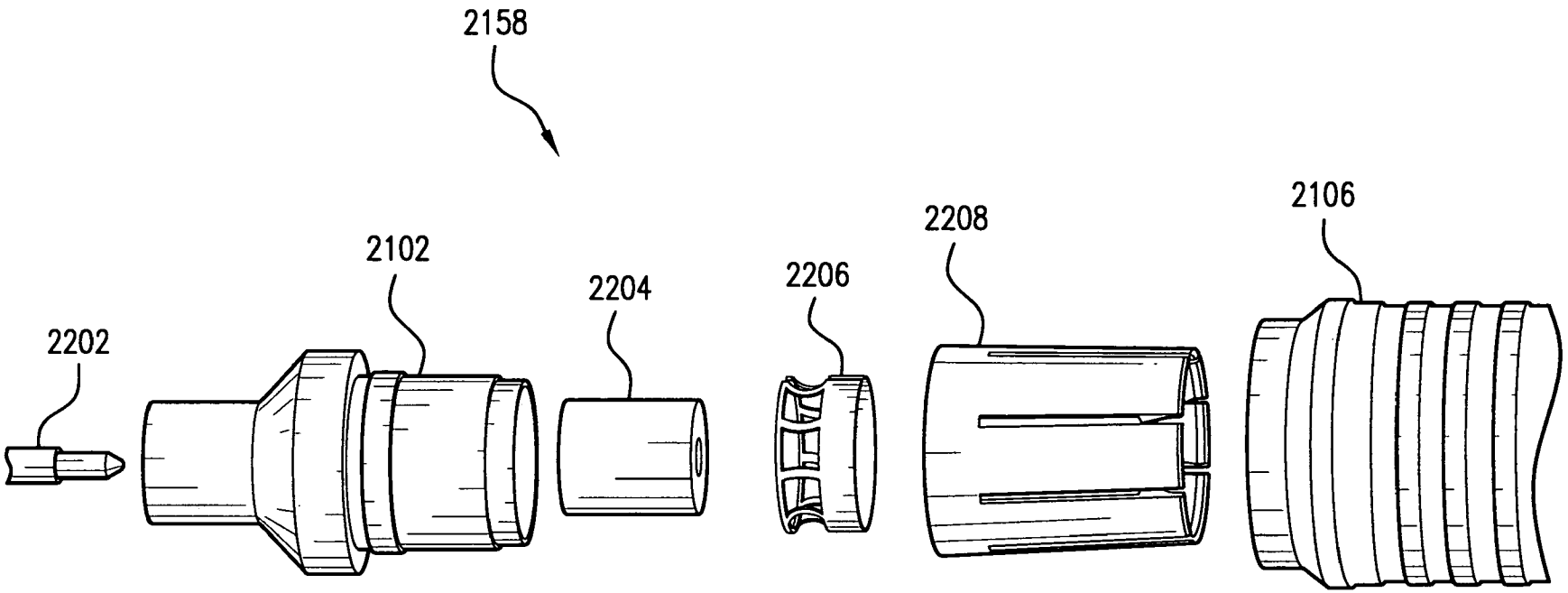

Referring now to FIG. 22, FIG. 22 is an exploded view of socket 2158 according to some embodiments. Accordingly, FIG. 22 illustrates the components of socket 2158 according to some embodiments. As shown in FIG. 22, socket 2158 includes housing 2102, an inner contact 2204, a dielectric body 2204 (a.k.a., "insulator 2204"), an outer contact 2206 or (a.k.a., ground contact 2206), a lock ring 2208, and shroud 2106. FIG. 22 shows inner contact 2204 being a male contact, but, in other embodiments, inner contact 2204 may be a female contact or other contact. As illustrated in the some of the other drawings, housing 2102 houses insulator 2204, inner contact 2202 and outer contact 2206, a front portion of housing 2202 is inserted into a rear opening defined by lock ring 2208, and lock rings 2208 fits within shroud 2106. To reduce cost, in some embodiments, outer contact 2206 and/or other components of the socket may be not utilized.

Figure 23:
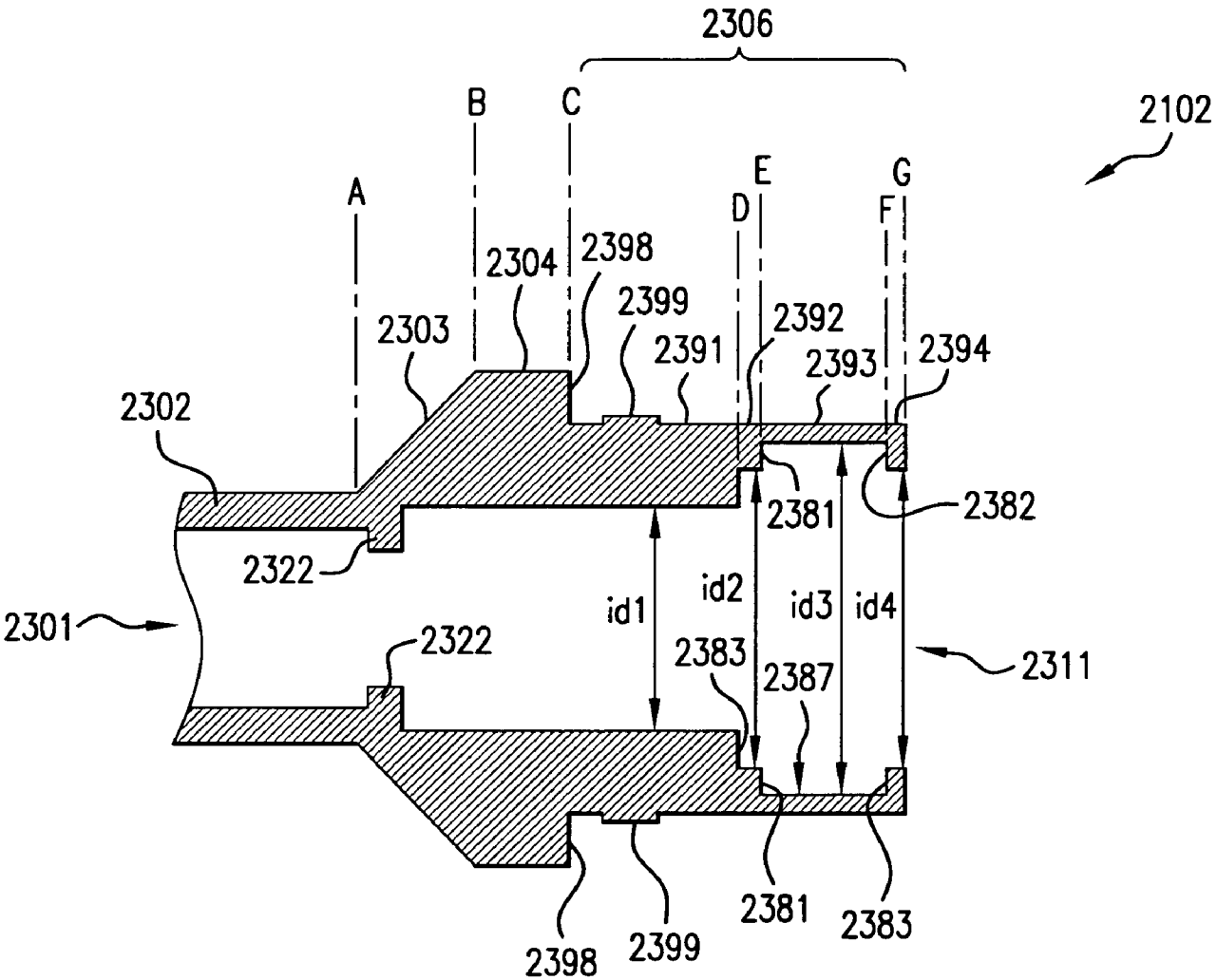
Figure 24:
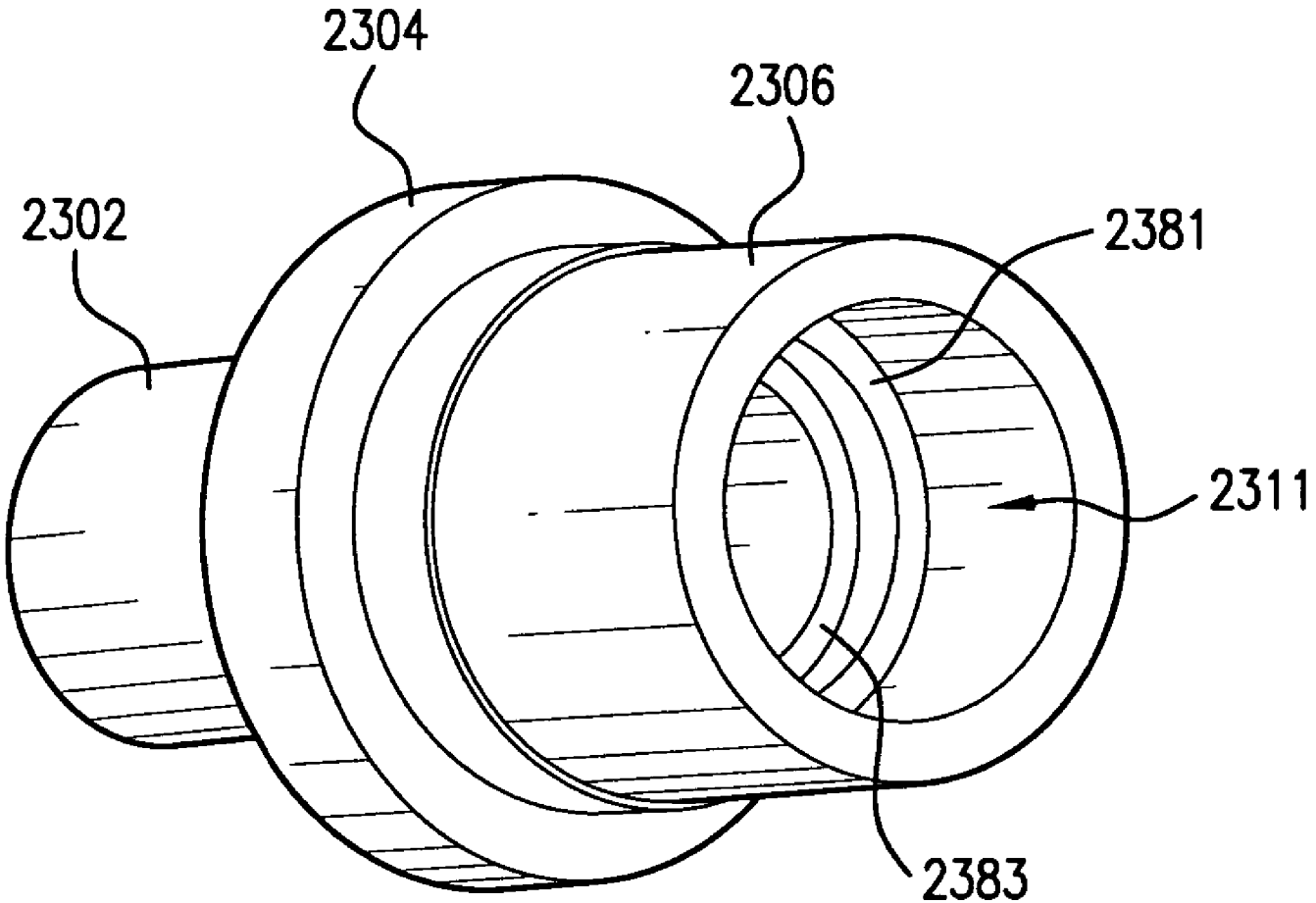

Referring now to FIGS. 23 and 24, FIG. 23 is a cross-sectional, side view of housing 2102 and FIG. 24 is a perspective view of housing 2102, both views according to one embodiment. As shown, housing 2102 may be generally cylindrical. Housing 2102 may also have a first end section 2302 (i.e., the section to the left of dotted line A), a second end section 2306 (i.e., the section to the right of dotted line C), and an interim section 2304 located between end sections 2302 and 2306 (i.e., the section between dotted lines B and C). Each section 2302, 2304 and 2306 may have an outer-diameter and an inner-diameter and define a cavity. For example, end section 2302 defines a cavity 2301 and end section 2306 defines cavity 2311. In some embodiments, an annular rib 2399 that extends outwardly is disposed on end section 2306. Preferably, rib 2399 is disposed adjacent to but slightly spaced from a wall 2398 formed at the junction of sections 2304 and 2306.

Preferably, there is provided a transition section 2303 between end section 2302 and interim section 2304. Transition section 2303 has a non-uniform outer-diameter. As shown in FIG. 23, at its largest, the outer-diameter of section 2303 is equal or about equal to the outer-diameter of section 2304, and, at its smallest, the outer-diameter of section 2303 is equal or about equal to the outer-diameter of section 2302. As shown in FIG. 23, transition section 2303 may include an inwardly projecting annular rib 2322.

Additionally, end section 2306 may consist of end portions 2391 and 2394 and interim portions 2392 and 2393. As shown, end portion 2391 is directly between interim portion 2391 and interim section 2304, interim portion 2392 is directly between end portion 2391 and interim portion 2393, and interim portion 2393 is directly between interim portion 2392 and end portion 2394.

As further shown in FIG. 23, portions 2391-2394 may be have substantially the same outer diameter but different inner diameters. For example, in the embodiment shown, the inner diameter of portion 2391 (i.e., "id1") is less than the inner diameter of portion 2392 (i.e., "id2"), and id2 is less than id3 (i.e., the inner diameter of portion 2393). In some embodiments, id2 may equal id4, which is the inner diameter of end portion 2394. Because id2 is less than id1, a wall 2383 is formed by portions 2391 and 2392. Also, because id3 is less than id2 and id4, walls 2381 and 2382 are formed by portions 2392 and 2393 and 2394 and 2393, respectively.

Figure 34:
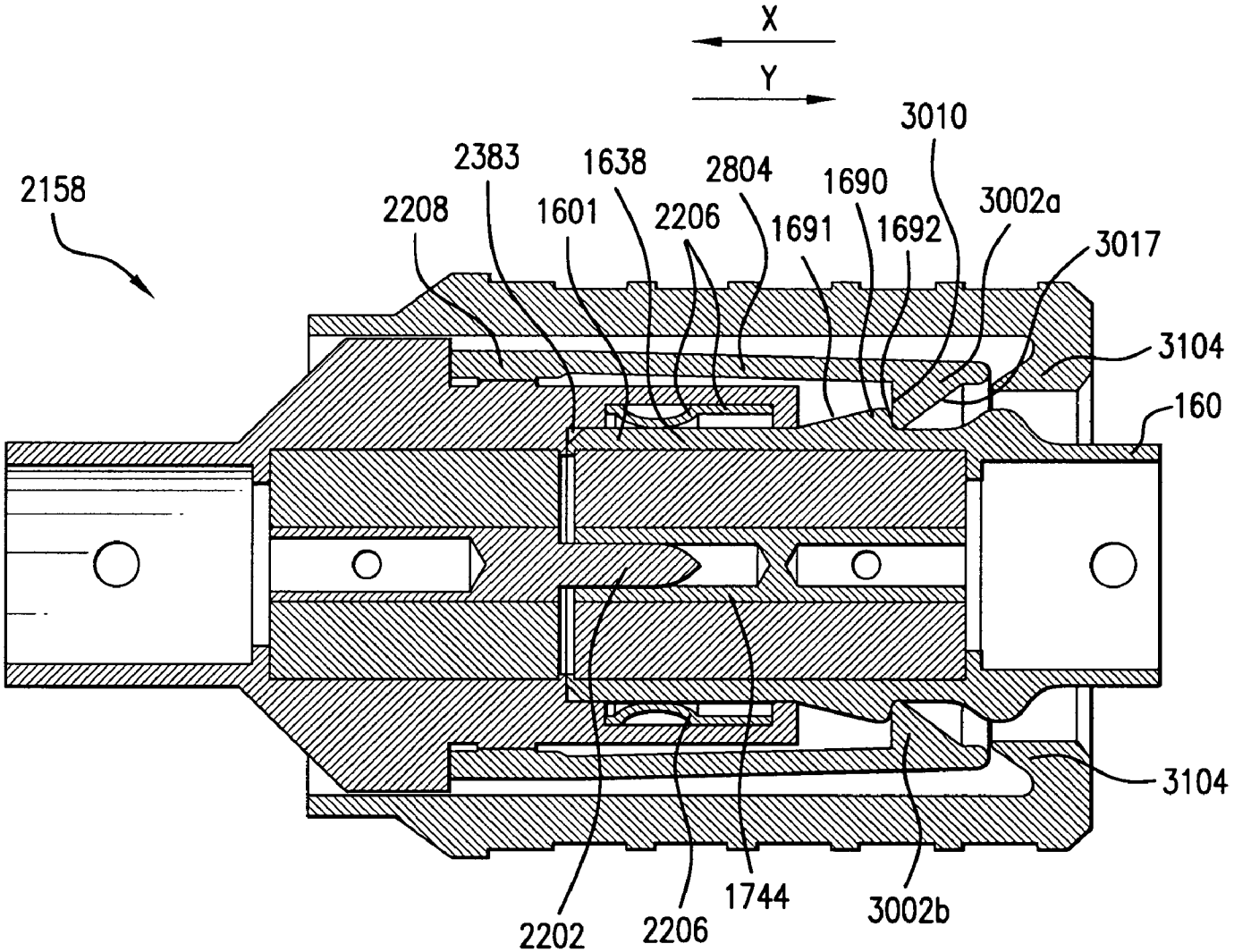

As discussed further herein with respect to FIG. 34, wall 2383 may function as a stopper that stops movement of plug 160 when plug 160 is inserted in to socket 2158. That is, in some embodiments id1 is less than the outer diameter of plug 160 while id2 is greater than the outer diameter of plug 160 so that when plug 160 is inserted in to socket 2158 the tip of plug 160 may contact wall 2383 (e.g., see FIG. 34), which stops the forward movement of plug 160.

Figure 25:
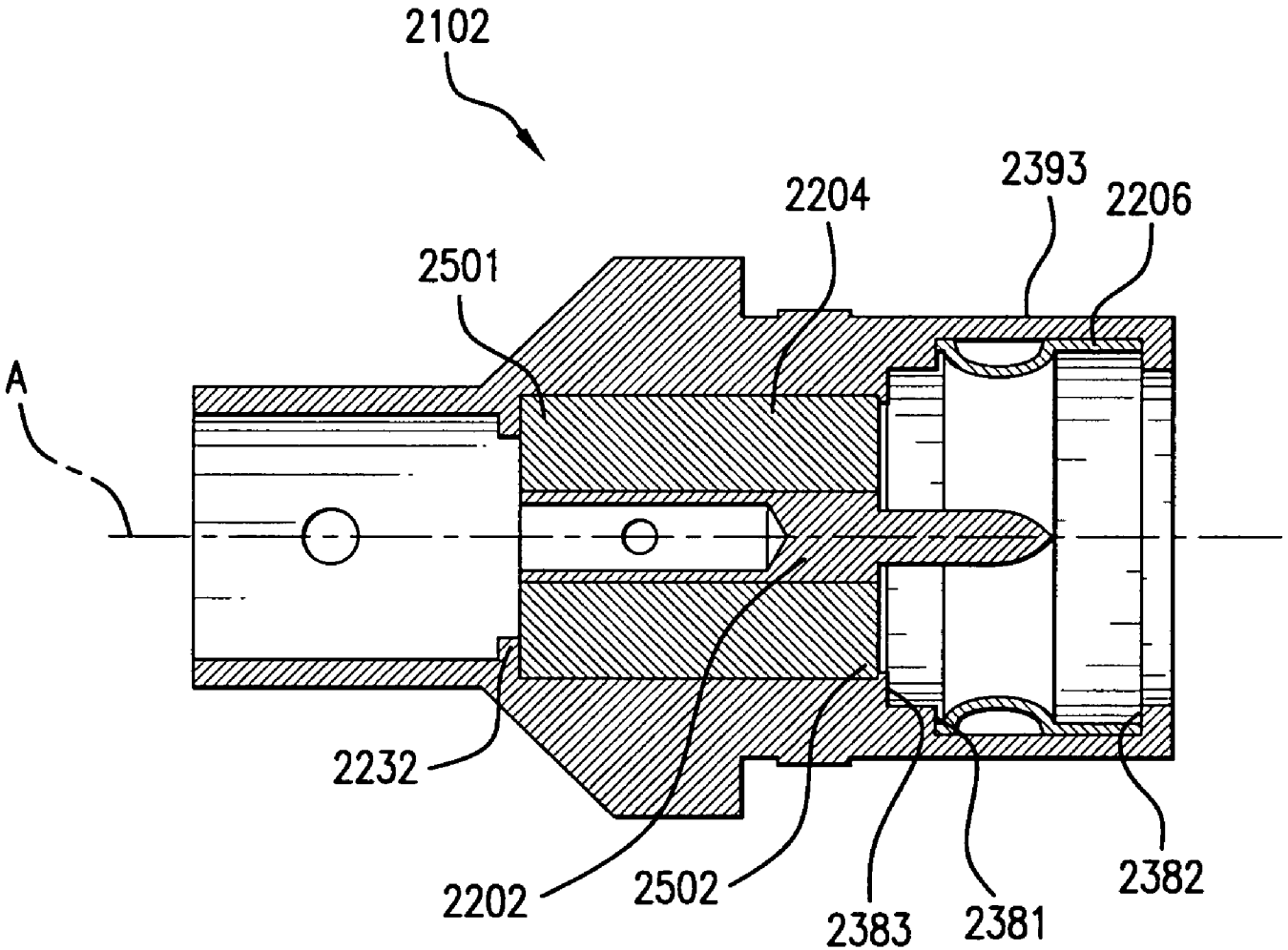

Referring now to FIG. 25, FIG. 25 illustrates insulator 2204 and contact 2202 housed in housing 2102. In the embodiment shown, contact 2202 is elongate and has a longitudinal axis that is aligned with the longitudinal axis of insulator 2204 and the longitudinal axis of housing 2102. Insulator 2204 surrounds at least a portion of contact 2202 and functions to electrically insulate contact from housing 2102, which is electrically conductive. Insulator 2204 is positioned within housings 2102 such that a end 2501 of insulator 2204 abuts or is adjacent to annular rib 2232 and an opposite end 2502 is substantially flush with wall 2383.

FIG. 25 also illustrates outer contact 2206 being housed in housing 2102. More specifically, in the embodiment shown, outer contact 2206 is disposed and retained between annular walls 2381 and 2382 that bound and define interim portion 2393. Outer contact 2206, according to one embodiment, is further illustrated in FIG. 26.

Figure 26:
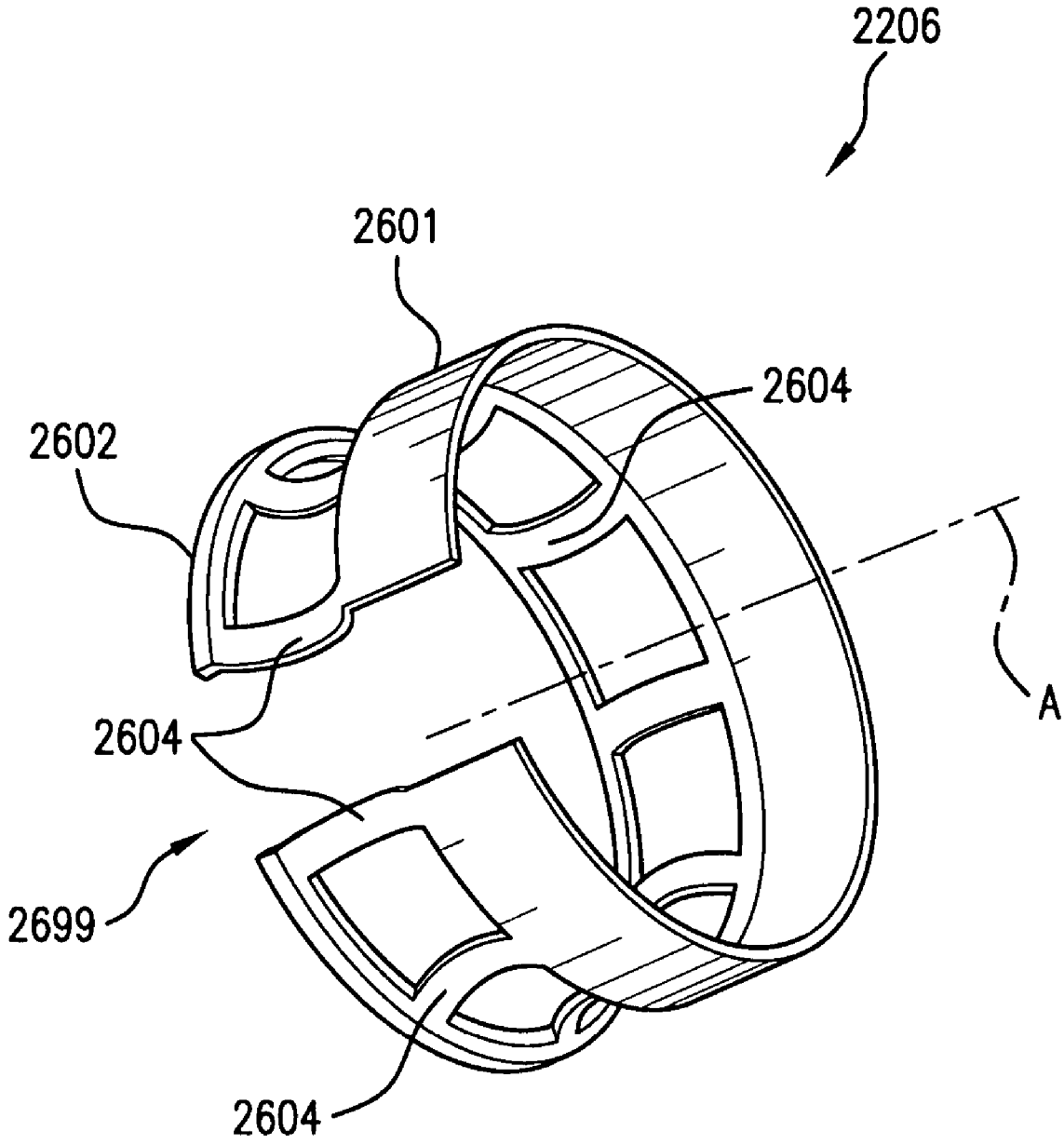

FIG. 26 is a perspective view of contact 2206 according to one embodiment. As shown, contact 2206 may be annular (e.g., shaped like a ring). In the particular embodiment shown, contact 2206 is a split ring (i.e., contact 2206 is generally ring shaped and has a gap 2699 between the ends of contact 2206). In the particular embodiment shown, contact 2206 includes a first split ring 2601, a second split ring 2602 and one or more generally U shaped contacts 2604 connecting the first ring 2601 with the second ring 2602. In the embodiment shown, rings 2601 and 2602 have substantially the same inner and outer diameters, but the width of ring 2601 is substantially greater then the width of ring 2602. Additionally, as shown, rings 2601 and 2602 are preferably arranged so that they are coaxial (e.g., they share a common central axis A), and generally U shaped contact(s) 2604 curve inwardly towards the central axis A.

Referring back to FIG. 25, contact 2206 is held tightly within an annular groove 2387 defined by walls 2381 and 2382 and the inner wall of portion 2393. Further, contact 2206 is arranged so that it is coaxial with housing 2102. That is, contact and housing have a common central axis.

Figure 27:
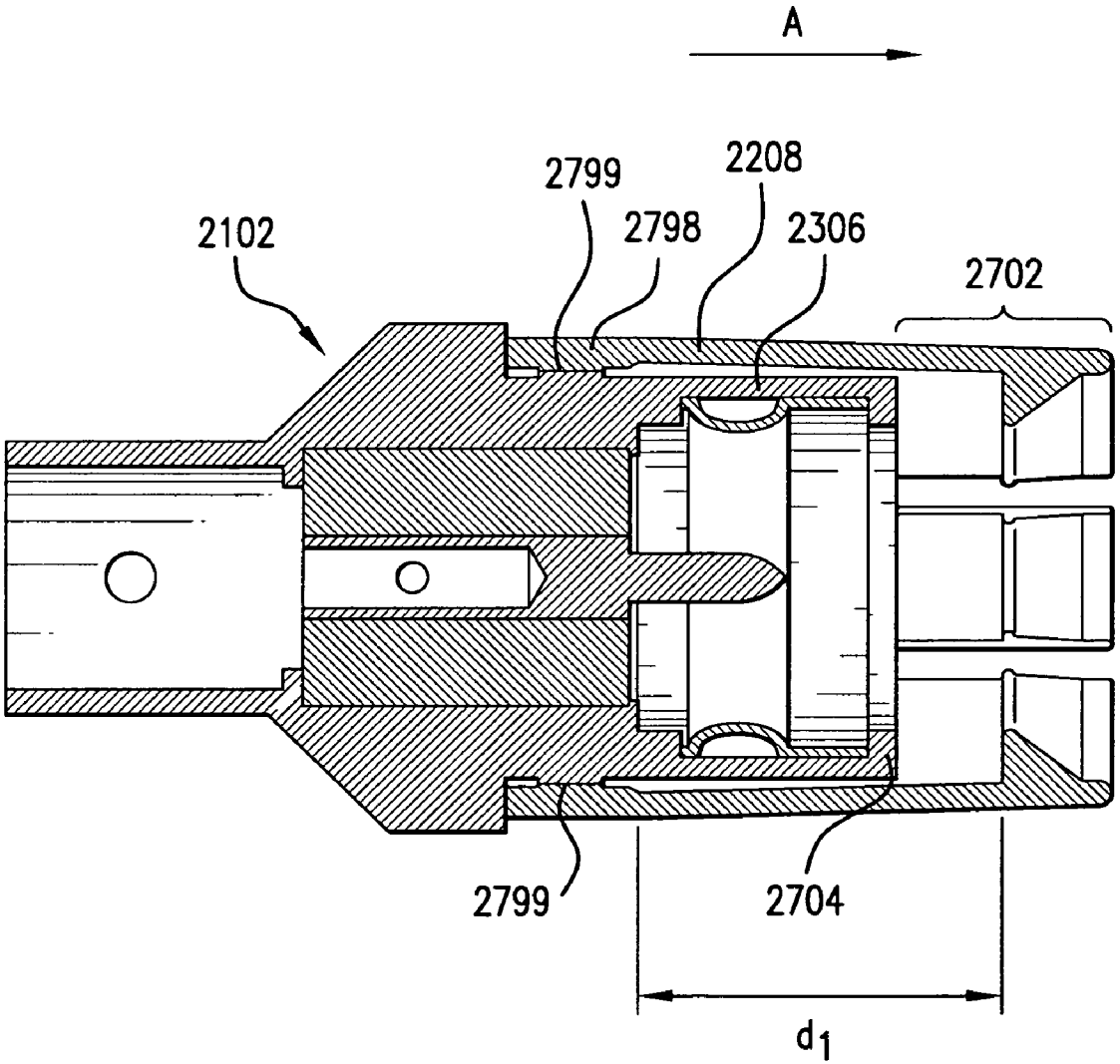

Referring now to FIG. 27, FIG. 27 is a cross-sectional side view of partially assembled socket 2158. FIG. 27 shows end section 2306 of housing 2102 inserted into proximal end of lock ring 2208. As shown, the length of section 2306 is less than the length of lock ring 2208 so that when end section is fully inserted into lock ring 2208, a front portion 2702 of lock ring 2208 extends beyond the end 2704 of end section 2306. As illustrated in FIG. 27, the inner-diameter of the proximal end of lock ring 2208 is only slightly larger than the outer-diameter of section 2306, thereby creating a snug fit between the components when they are mated.

Preferably, when housing 2102 and lock ring 2208 are mated as shown in FIG. 27, lock ring 2208 is fixed to housing 2102 so that lock ring 2208 can not move in the direction of arrow A even when a significant force is exerted on lock ring 2208 in the direction of arrow A. For this purpose, an annular rib 2399 (see FIG. 23) may be provided. That is, annular rib 2399 may be employed to prevent or assist in preventing lock ring 2208 from being able to move in the direction of arrow A after housing 2102 and lock ring 2208 are fully mated. Additionally, lock ring 2208 may have a tab 2799 projecting from an inner surface of a base ring 2798 portion of lock ring 2208, which tab cooperates with annular rib 2399 to fix lock ring 2208 to housing 2102.

Figure 28:
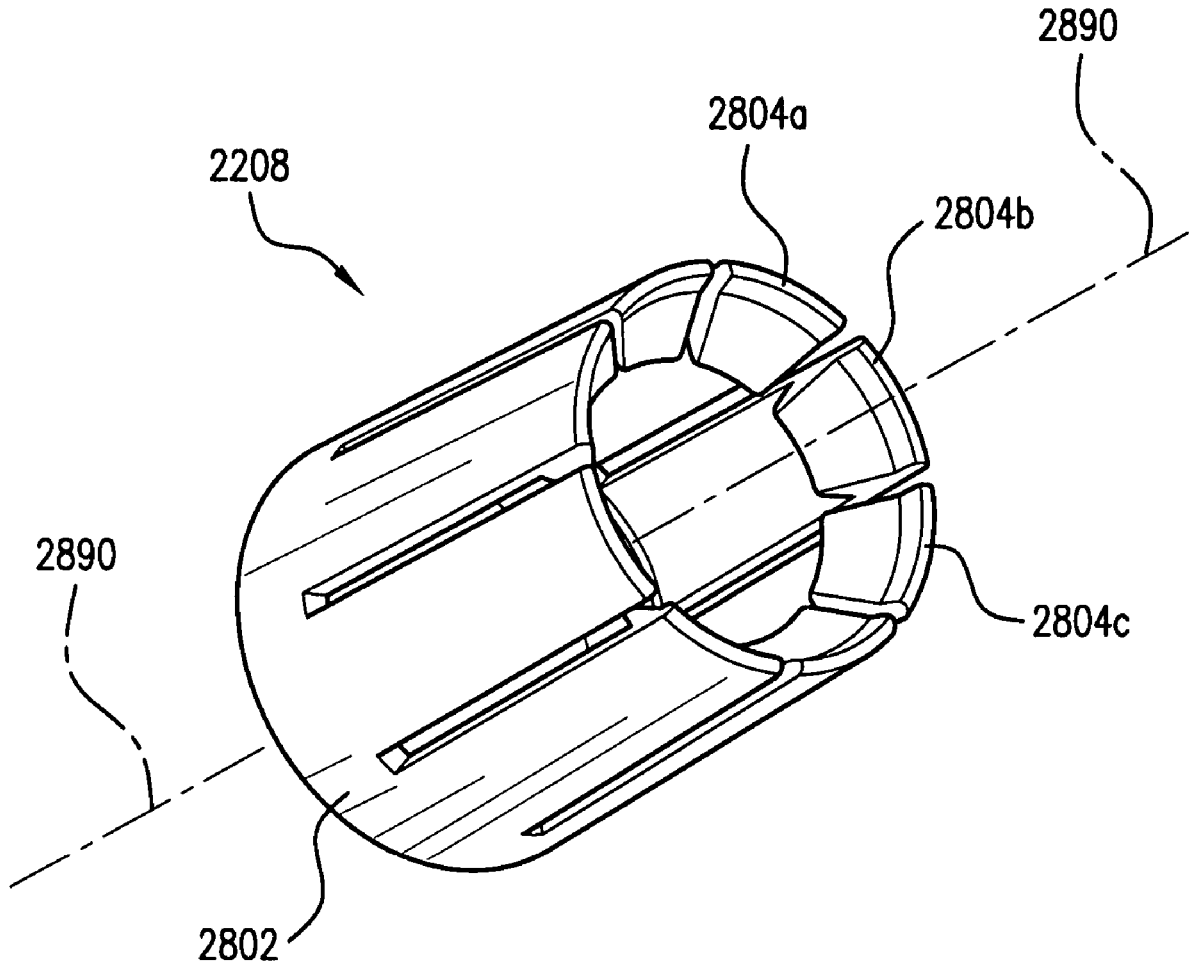

Referring now to FIG. 28, FIG. 28 further illustrates lock ring 2208 according to one embodiment. In the embodiment shown, lock ring 2208 includes base ring 2798 and one or more fingers 2804 attached to base ring 2798. Finger(s) 2804 may be integrally attached to base ring 2798 so that base ring 2798 and finger(s) 2804 form a single unit. As shown, fingers 2804 extend in the same general direction as the central axis 2890 of base ring 2798. That is, in some embodiments, the longitudinal axis of each finger 2804 is generally parallel (but not precisely parallel) with the central axis 2890 of base ring 2798. In one particular embodiment, for example, there is about a 2 degree angle between the longitudinal axis of each finger 2804 and the central axis 2890 of lock ring 2208. Preferably, in embodiments where there is more than one finger 2804, the fingers 2804 are arranged at regular angular intervals around base ring 2798.

Figure 29:
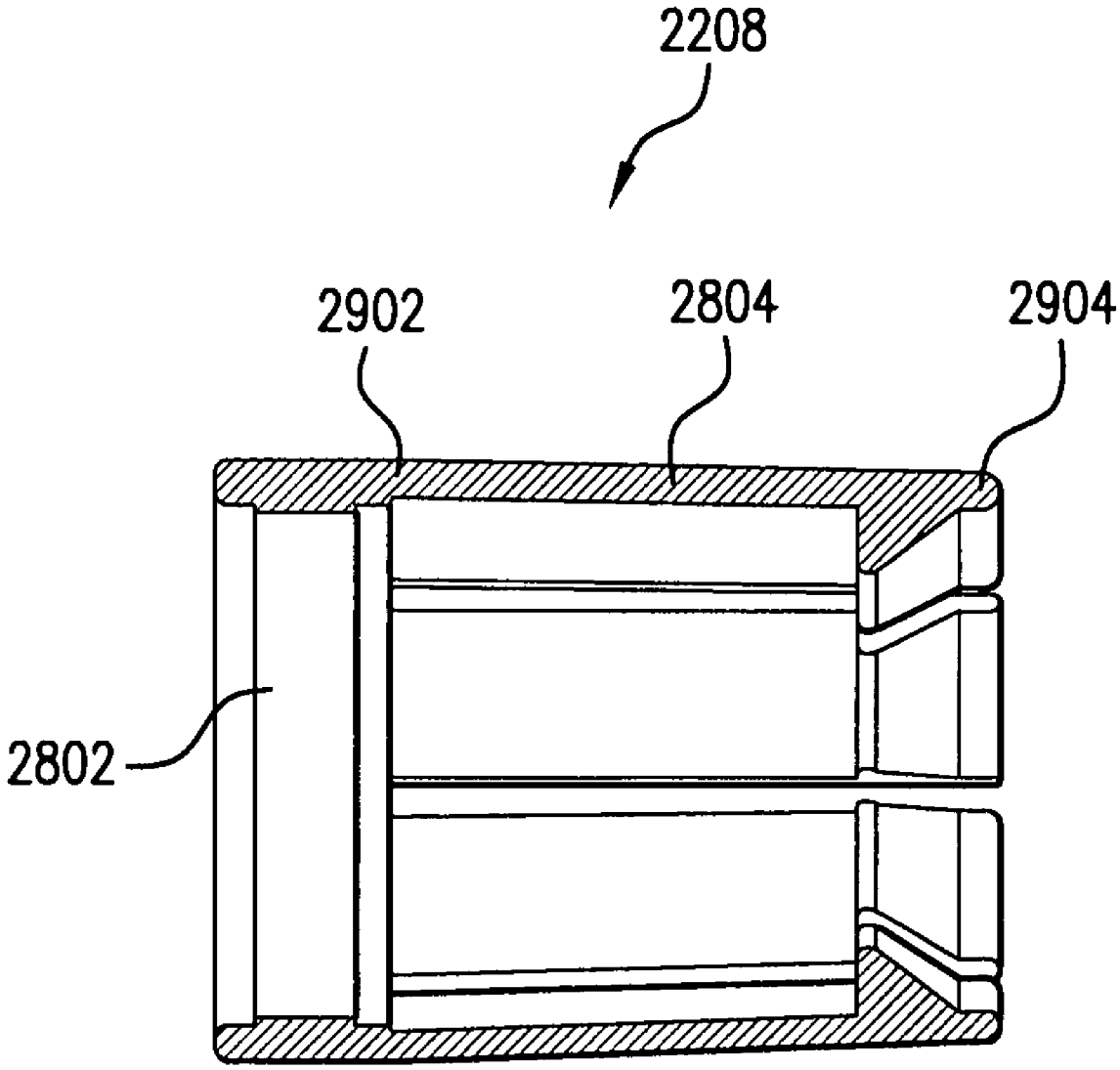
Figure 30:
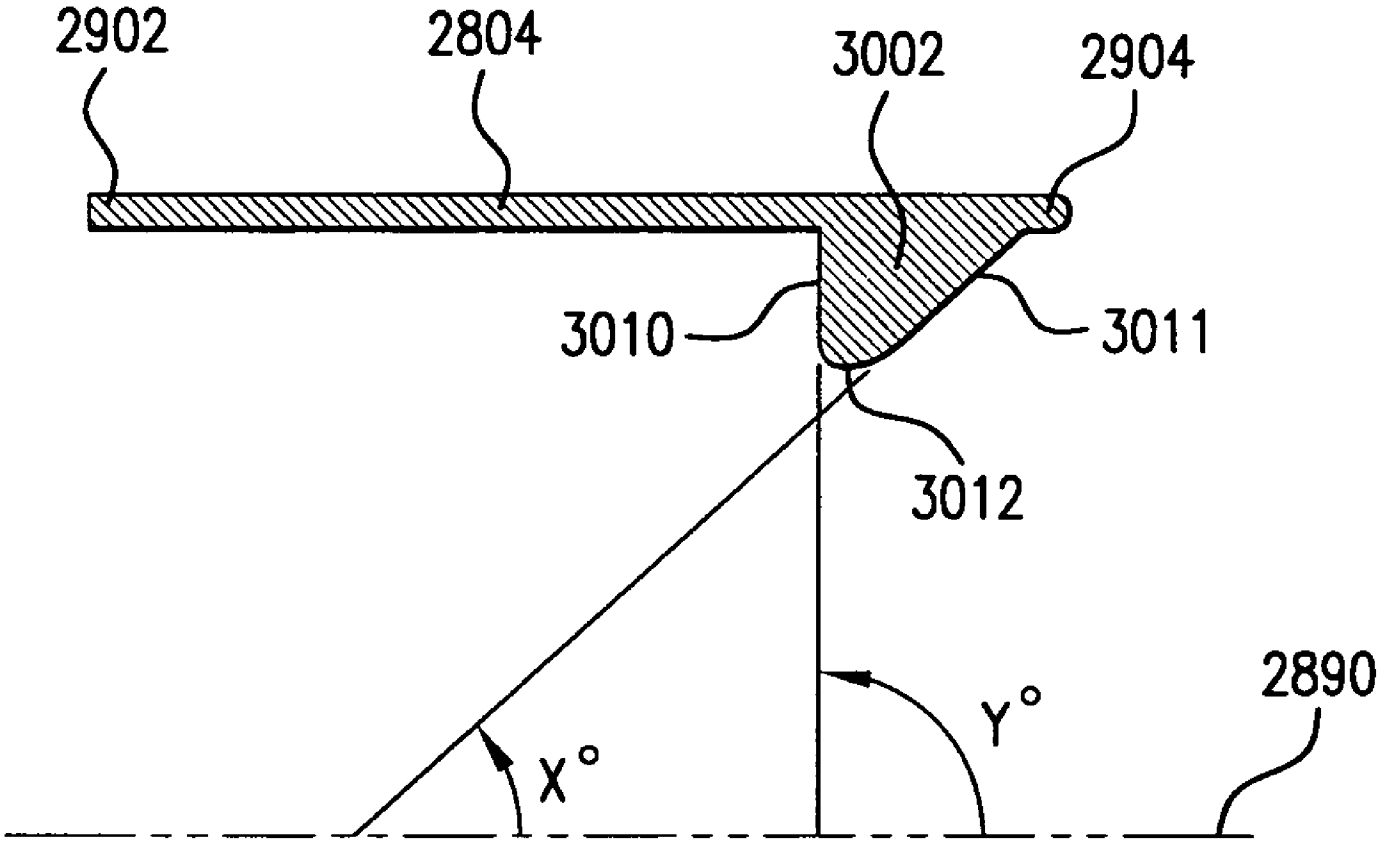

Referring now to FIG. 29 and FIG. 30, FIG. 29 is a cross-sectional view of lock ring 2208 and FIG. 30 is a cross-sectional view of one of the fingers 2804 of lock ring 2208. As shown in FIG. 29, fingers 2804 are arranged at regular angular intervals around base ring 2798 and each finger has a proximal end 2902 connected to base ring 2798 and an opposite distal end or "tip" 2904. As shown in FIG. 30, in some embodiments, spaced inwardly from distal end 2904 is a lock tab 3002 that projects from the inner surface 3001 of finger 2804 towards the central axis of lock ring 2208.

In the embodiment shown in FIG. 30, lock tab 3002 has a planar back wall 3010 generally facing proximal end 2902 and a planar front wall generally facing distal end 2904. Back wall 3010 lies on a plane that forms an angle Y with the central axis 2890 of lock ring 2208. In one embodiment, as shown, angle Y is 90 degrees or thereabout. Front wall 3011 is angled towards back wall 3010 and lies on a plane that forms an angle X with the central axis 2890 of lock ring 2208. In one embodiment, angle X is between 20 and 60 degrees or thereabout. In one particular embodiment, angle X is about 36 degrees. A rounded bottom wall 3012 connects front wall 3011 with back wall 3010.

Figure 31:
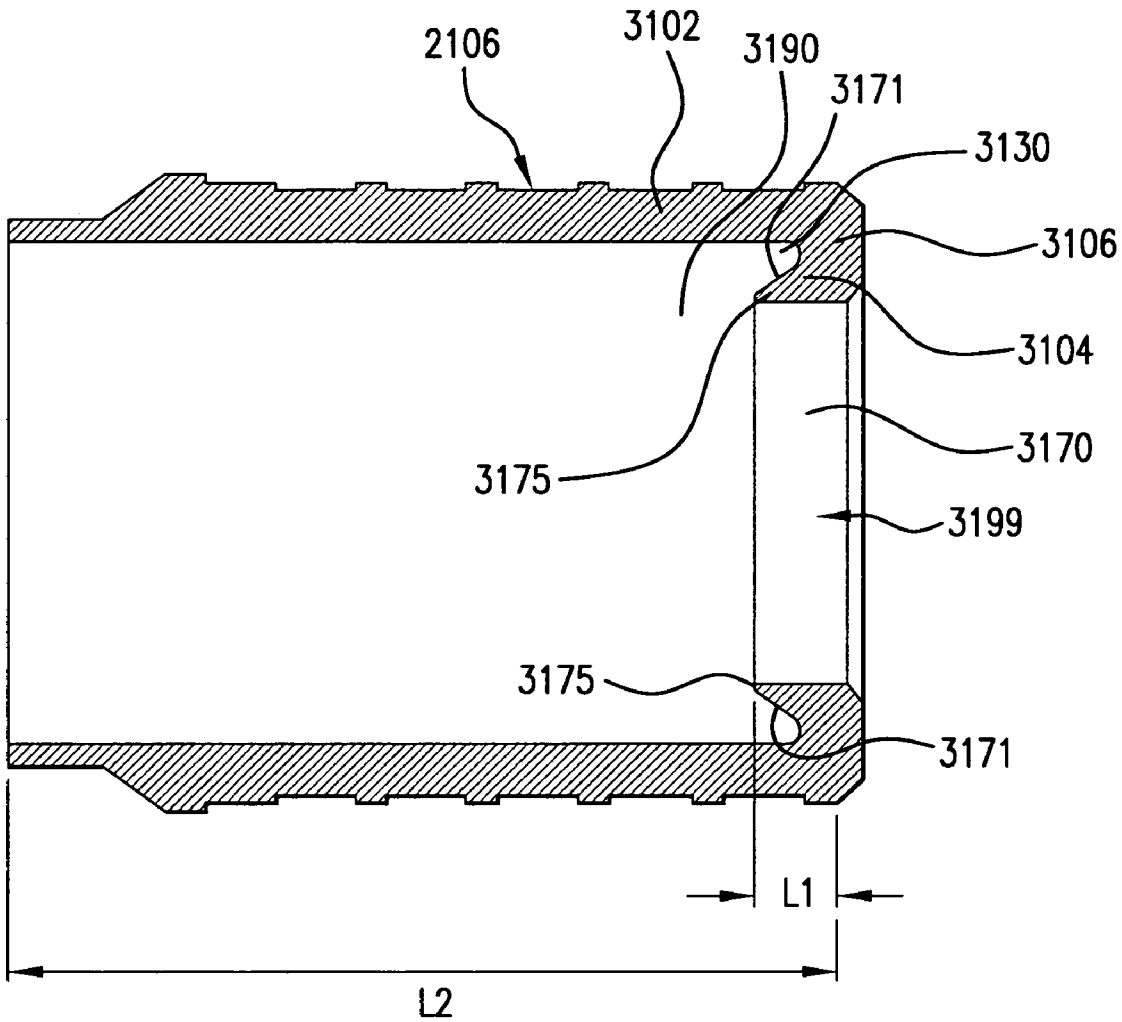
Figure 32:
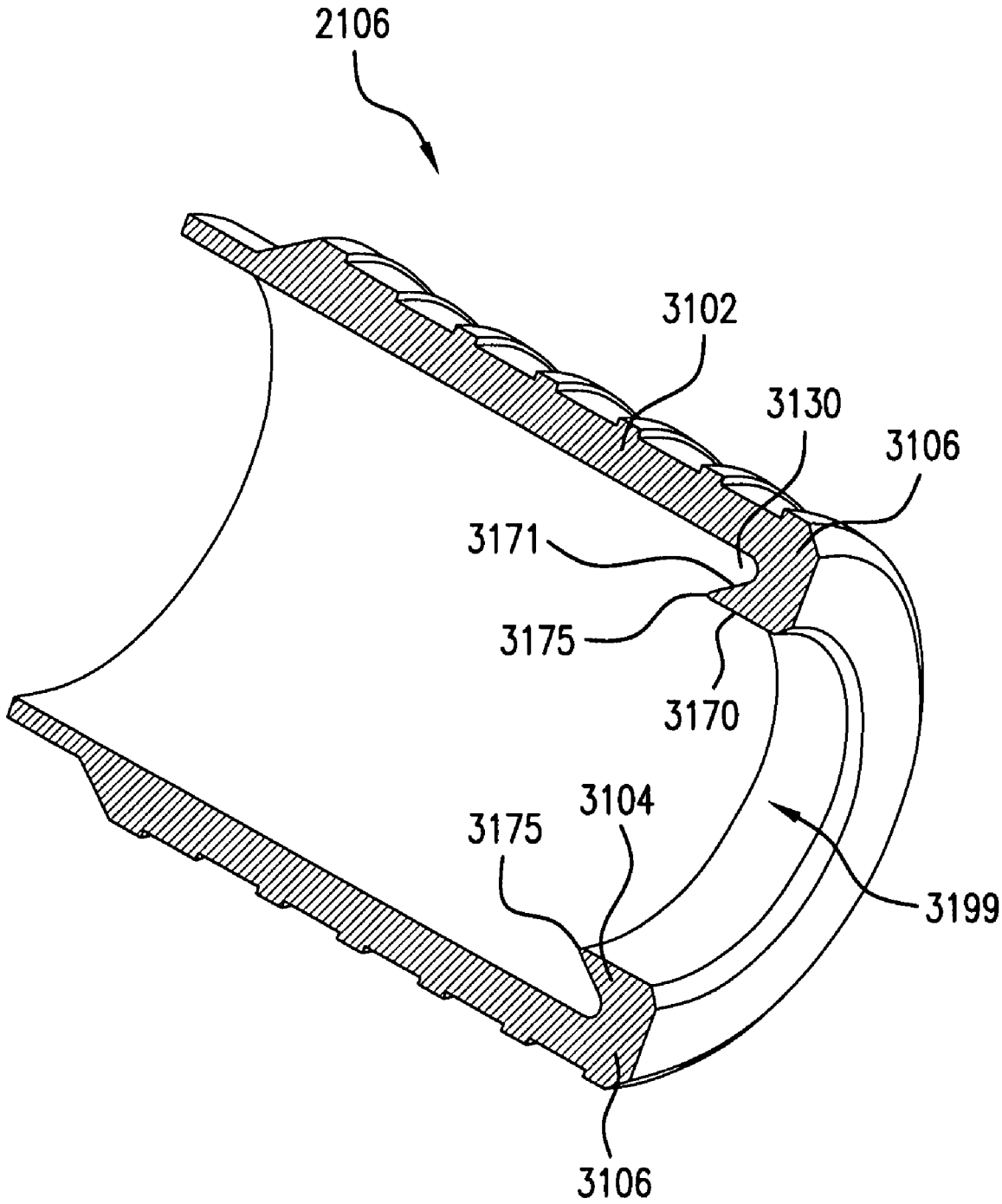

Referring now to FIG. 31 and FIG. 32, FIG. 31 is a cross-sectional, side view of shroud 2106 and FIG. 32 is a cross-sectional, perspective view of shroud 2106, both views according to one embodiment. As shown, shroud 2106 may have an outer wall or "outer sleeve" 3102, an inner wall or "inner sleeve" 3104, and a connecting member 3106 connecting the inner wall 3104 to the outer wall 3102. In the embodiment shown walls 3102 and 3104 are each in the form of a ring. In this embodiment, outer ring wall 3102 encloses a space 3190 and inner ring wall 3104 is disposed in space 3190 and is coaxial with outer ring wall 3102. Further, connecting member 3106 is connected between an end of wall 3102 and an end wall 3104. Walls 3102 and 3104 and member 3106 define a space 3130. Preferably, the length (L1) of inner wall 3104 is significantly less than the length (L2) of outer wall 3102.

Inner wall 3104 has two major sides, an inner side 3170 and an outer side 3171. Inner side 3170 of wall 3104 defines an opening 3199. As shown in FIG. 31, outer side 3171 is not parallel with respect to inner side 3170 so that in some embodiments the two sides converge to form an annular ridge 3175.

Figure 33:
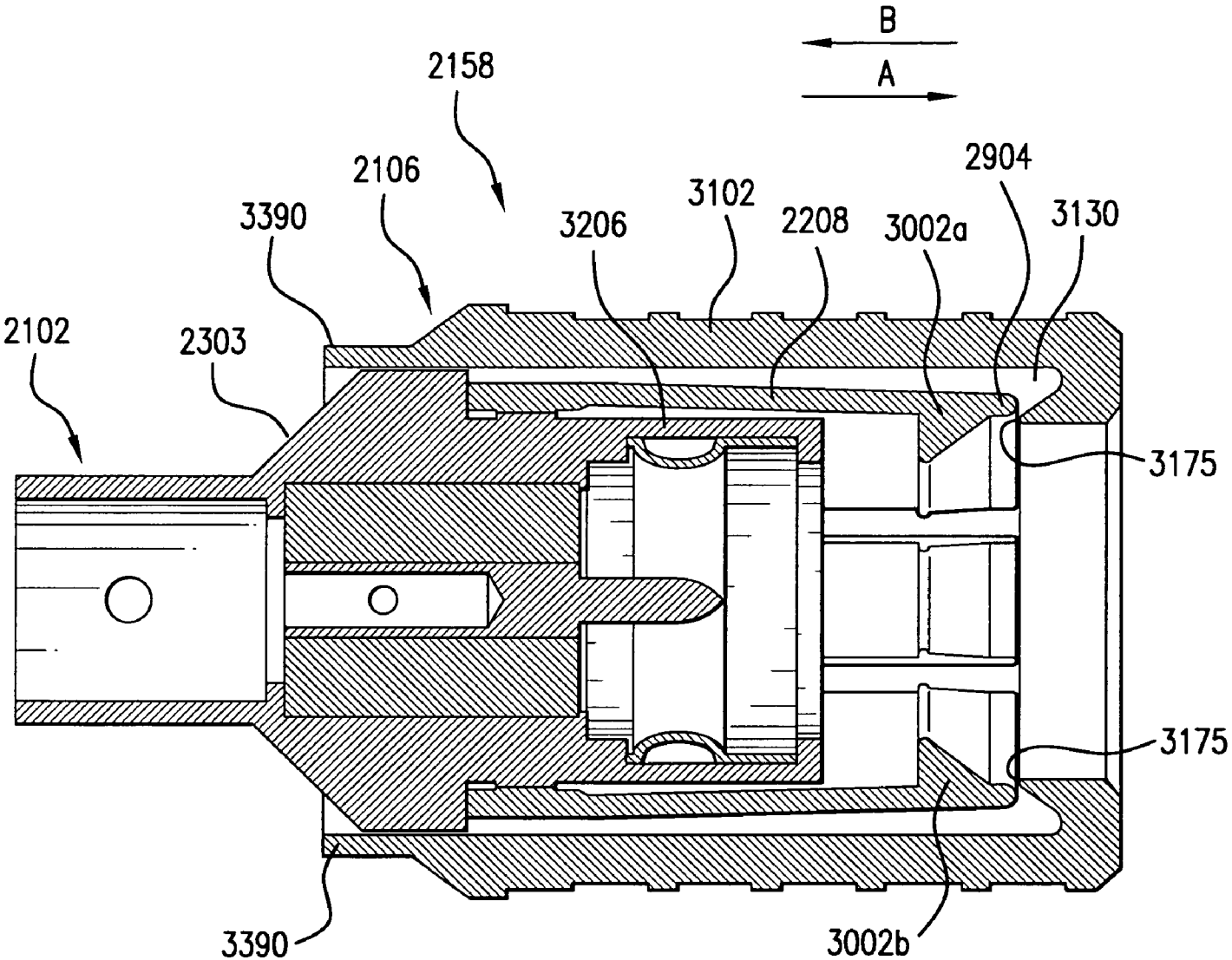

Referring now to FIG. 33, FIG. 33 is a cross-sectional, side view of socket 2158, according to one embodiment, after it is fully assembled. As shown, in FIG. 33, when socket 2158 is fully assembled, end portion 2306 of housing 2102 is inserted into lock ring 2208 and then that assembly of components is inserted into shroud 2106 such that shroud surrounds end portion 2306 and lock ring 2208.

It is preferred that shroud 2106 be fixed to housing 2102. Shroud 2106 may be fixed to housing 2102 by inserting end section 2306 into shroud 2106 as shown in FIG. 33, and then folding down end portion 3390 of wall 3102 so that when shroud 2106 is moved relative to housing 2102 in the direction of arrow A in FIG. 33, folded over end portion 3390 eventually contacts a surface of transition section 2303 of housing 2102, thereby preventing further movement of shroud 2106 relative to housing 2102 in the direction of arrow A.

Preferably, shroud 2106 is fixed to housing 2102 in such a way that shroud 2106 can move in a direction parallel to the longitudinal axis of socket 2158 between an "unlocked" and a "locked" position. To position shroud 2106 in the unlocked position, shroud 2106 is moved in the direction of arrow B so that ridge 3175 contacts and presses against the surface 3011 of lock tabs 3002 of fingers 2804, thereby exerting a force on the fingers 2804, which force causes the fingers 2804 to flex outwardly.

To position shroud in the unlocked position, the shroud is moved in the direction of arrow A relative to lock ring 2208 to an extent wherein ridge 3175 does not exert any or any significant outward force on fingers 2804. FIG. 33 shows shroud 2106 positioned in the locked position. As shown in FIG. 33, in this embodiment, ridge 3175 does not press against the surface 3011 of lock tabs 3002, but rather contacts or is adjacent to the tips 2904 of fingers 2804. It should be noted that space 3130 is configured to receive tips 2904 when shroud 2106 is moved into the unlocked position.

If no external forces act on shroud 2106 when shroud 2106 is in the unlocked position, shroud 2106 will automatically return to the locked position because, due to the elasticity of fingers 2804, fingers 2804 will exert a force on shroud 2106 in the direction of arrow A, which force will cause the shroud 2106 to move in the direction of arrow A and into the locked position.

Referring now to FIG. 34, FIG. 34 shows plug 160 fully inserted into socket 2158, according to an embodiment. In one embodiment, as shown in FIG. 34, when plug 160 is fully inserted into socket 2158, plug contact 1744 conductively mates with socket contact 2202. In the embodiment shown, plug contact 1744 is a female contact while socket contact 2202 is a male contact. In one alternative embodiment, plug contact 1644 is a female contact while socket contact 310 is a male contact. Additionally, protuberance 1690 and the fingers 2804 of lock ring 2208 cooperate to "lock" plug 160 inside of socket 2158. That is, protuberance 1690 and lock ring 2208 prevent contacts 2202 and 1744 from becoming unmated because protuberance 1690 and lock ring 2208 limit plug 160's movement in the direction of arrow Z.

In the embodiment shown, when plug 160 is inserted into socket 2158, the sloping surface 1691 of protuberance 1690 is the first portion of protuberance 1690 to contact the lock tab 3002 of fingers 2804. Because fingers 2804 are somewhat springy, when plug 160 is pushed into socket 2158, sloping surface 1691 presses against surface 3011 of fingers

2804, thereby causing fingers 2804 to move outwardly allowing protuberance 1690 to pass under the lock tabs 3002 (lock tabs 3002*a* and 3002*b* are shown in FIG. 34). Once protuberance 1690 has passed under the lock tabs 3002 of the fingers 2804, the fingers 2804 automatically return to their original position, as shown in FIG. 34.

When fingers 2804 return to their original position, the back wall 3010 of each finger 2804 is positioned opposite and facing surface 1692 of protuberance 1690. Thus, if one attempts to move plug 160 relative to socket 2158 in the direction of arrow Z, surface 1692 will contact back wall 3010 of each finger 2804 and exert a force thereon in the direction of arrow Z. In a preferred embodiment, wall 3010 exerts a substantially equal and opposite force on surface 1692 because, as discussed above, lock ring 2208 is preferably fixed to housing 2102. Accordingly, unless shroud 2106 is in the unlocked position, pushing or pulling on plug 160 in the direction of arrow Z will not (in most cases) remove plug 160 from socket 2158. That is, when shroud 2106 is in the locked position, only a large pulling/pushing force on plug 160 will disengage plug 160 from socket 2158.

Accordingly, to remove plug 160 from socket 2158, one moves shroud 2106 from its steady state locked position to the unlocked position. As discussed above, to move shroud to the unlocked position, shroud 2106 is moved relative to housing 2102 a distance in the direction of arrow X (see FIG. 34). The distance needs to be great enough so that inner sleeve 3104 contacts and presses against the lock tables 3002 of fingers 2804, thereby urging fingers 2804 upwardly to an extent that protuberance 1690 can pass under the lock tabs 3002. When shroud 2106 is in its unlocked position, one can remove plug 160 from socket 150 by pulling on plug 160 in the Z direction with a minimal amount of force.

Referring to FIG. 34 and specifically to contact 2206, contact 2206 preferably is a split ring (see FIG. 26). When plug 160 is inserted into socket 158, at least a part of front portion 1601 contacts an inner surface of contact 2206 and exerts a radial force on contact 2206 that causes contact 2206 to open (i.e., causes gap 2699 to grow wider). Contact 2206 responds to this force by exerting a radial force on housing 1638. This force between ground contact 2206 and conductive housing 1638 creates a good electrical connection between contact 2206 and housing 1638. In the particular embodiment shown, at least a part of front portion 1601 contacts the inner surface of U shaped contacts 2604 but does not contact either split ring 2601 or 2602.

As illustrated in the embodiment shown in FIG. 34, the distance (d1—see FIG. 27) from wall 2383 to back wall 3010 of lock tab 3002 is equal or about equal to the distance (d2—see FIG. 18) from the front end of plug 160 to a point at the bottom of surface 1692 of protuberance 1690. Accordingly, in the embodiment shown, wall 2383 functions as a stopper that limits how far plug can be inserted into socket 2158.

Figure 35:
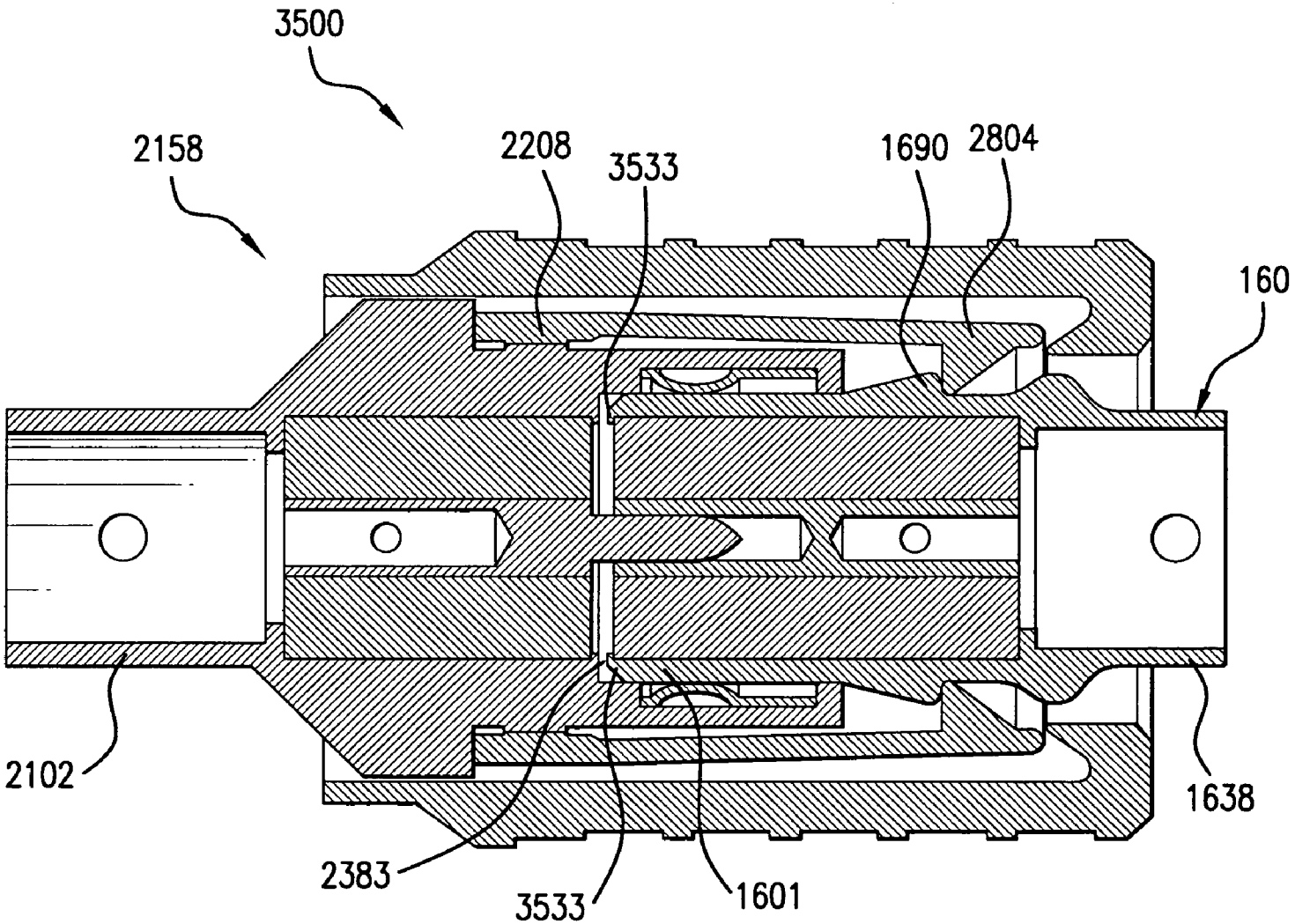
FIG. 35 illustrates a connector according to another embodiment.

Referring now to FIG. 35, FIG. 35 is a cross-sectional, side view of a snap lock connector apparatus 3500 according to another embodiment. Connector apparatus is similar to connector apparatus 2100. As illustrated in FIG. 35, the main difference between connector apparatus 3500 and apparatus 2100 is that when plug 160 is inserted into the distal end of socket 2158 and locked within socket 2158 by lock ring 2208, the tip 3533 of front portion 1601 of plug housing 1638 does not contact wall 2383 of housing 2102. That is, in the alternative embodiment, when plug 160 is fully inserted and locked within socket 2158, there exists a gap between tip 3533 and wall 2383. In some embodiments, the gap is at least about 0.005 inches wide.

Consequently, in the alternative embodiment, when plug 160 is locked within socket 2158 by fingers 2804, the fingers 2804 may exert an axial force on plug 160 by pressing against protuberance 1690, but the axial force does not causes the front surface 3533 of plug 160 to press against wall 2383.

While various embodiments/variations of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A socket, comprising:

a socket housing;

an insulator disposed within said socket housing;

a first contact, wherein the insulator is configured to electrically insulate the first contact from the socket housing;

a lock ring disposed about a distal end of said socket housing; and a shroud disposed about said distal end of said socket housing and said lock ring and moveable relative to said socket housing between a first position and a second position, said shroud having an outer wall and an inner wall, wherein, said shroud and said lock ring are configured so that when said shroud moves from said first position to said second position, said inner wall contacts said lock ring and causes said lock ring to flex outwardly, wherein the socket is configured such that when a plug is inserted into the distal end of the socket and locked in place by the lock ring, the lock ring exerts an axial force on the plug, but the axial force does not cause a front surface of the plug to press against any (a) electrically conductive surface of the socket or (b) electrically conductive component of the socket.

2. The socket of claim 1, wherein the inner wall of the shroud has two major surfaces, an inner surface and an outer surface, wherein the outer surface of the inner wall is not parallel with the inner surface of the inner wall so that the two surfaces converge to form an annular ridge.

3. The socket of claim 1, wherein the socket further comprises a ground contact housed within said socket housing, wherein said ground contact is metallic and is configured to electrically connect the socket housing with the plug when the plug is fully inserted into the socket housing.

4. The socket of claim 3, wherein the ground contact is annular.

5. The socket of claim 3, wherein the ground contact is in the form of a split ring.

6. The socket of claim 3, wherein the ground contact is housed within an annular groove located in an inner surface of the socket housing.

7. The socket of claim 6, wherein the ground contact is arranged so that it is coaxial with the socket housing.

8. The socket of claim 3, wherein the ground contact includes a first split ring, a second split ring and one or more generally U shaped contacts connecting the first split ring with the second split ring, wherein the split rings are arranged so that they are coaxial.

9. The socket of claim 8, wherein the first split ring and the second split ring have substantially the same inner and outer diameters, but the width of the first split ring is substantially greater then the width of the second split ring.

10. The socket of claim 9, wherein the generally U shaped contacts curve inwardly towards the central axis of the ground contact.

11. The socket of claim 1, wherein the lock ring comprises a base ring and a finger attached to the base ring, wherein the finger extends in the same general direction as the central axis of the base ring.

12. The socket of claim 11, wherein the longitudinal axis of the finger is generally parallel but not precisely parallel with the central axis of the base ring such that there is at least about a two (2) degree angle between the longitudinal axis of the finger and the central axis of the lock ring.

13. The socket of claim 12, wherein the finger has a proximal end connected to the base ring, an opposite distal end, and a lock tab spaced inwardly from the distal end, wherein the lock tab projects from an inner surface of the finger towards the central axis of the lock ring.

14. The socket of claim 13, wherein the lock tab has a planar back wall generally facing the proximal end and a planar front wall generally facing distal end, wherein the back wall lies on a plane that forms an angle Y with the central axis of the lock ring, wherein angle Y is about 90 degrees.

15. The socket of claim 14, wherein the front wall is angled towards the back wall and lies on a plane that forms an angle X with the central axis of the lock ring, wherein angle X is between about 20 and 60 degrees.

16. The socket of claim 15, wherein angle X is about 36 degrees.

17. The socket of claim 15, wherein a rounded bottom wall connects the front wall with the back wall.

18. A socket, comprising:

a housing having an annular groove formed in an inner surface of the housing; and an annular ground contact disposed in the annular groove, wherein the annular ground contact is arranged so that it is coaxial with the socket housing, the ground contact includes a first split ring, a second split ring and two or more generally U shaped contacts connecting the first split ring with the second split ring, and the first split ring and the second split ring have substantially the same inner and outer diameters, but the width of the first split ring is substantially greater than the width of the second split ring.

19. The socket of claim 18, further comprising:

an insulator disposed within said housing; and a first contact, wherein the insulator is configured to electrically insulate the first contact from the socket housing.

20. The apparatus of claim 18, wherein the ground contact is in the form of a split ring.

21. The apparatus of claim 18, wherein the generally U shaped contacts curve inwardly towards the central axis of the ground contact.

22. The socket of claim 19, further comprising a lock ring disposed about a distal end of said housing.

23. The socket of claim 22, further comprising a shroud disposed about said distal end of said housing and said lock ring and moveable relative to said housing between a first position and a second position, said shroud having an outer wall and an inner wall, wherein, said shroud and said lock ring are configured so that when said shroud moves from said first position to said second position, said inner wall contacts said lock ring and causes said lock ring to flex outwardly.

24. The apparatus of claim 23, wherein the inner wall of the shroud has two major surfaces, an inner surface and an outer surface, wherein the outer surface of the inner wall is not parallel with the inner surface of the inner wall so that the two surfaces converge to form an annular ridge.

25. The apparatus of claim 22, wherein the lock ring comprises a base ring and a finger attached to the base ring, wherein the finger extends in the same general direction as the central axis of the base ring.

26. The apparatus of claim 25, wherein the longitudinal axis of the finger is generally parallel but not precisely parallel with the central axis of the base ring such that there is at least about a two (2) degree angle between the longitudinal axis of the finger and the central axis of the lock ring.

27. The apparatus of claim 26, wherein the finger has a proximal end connected to the base ring, an opposite distal end, and a lock tab spaced inwardly from the distal end, wherein the lock tab projects from an inner surface of the finger towards the central axis of the lock ring.

28. The apparatus of claim 27, wherein the lock tab has a planar back wall generally facing the proximal end and a planar front wall generally facing distal end, wherein the back wall lies on a plane that forms an angle Y with the central axis of the lock ring, wherein angle Y is about 90 degrees.

29. The apparatus of claim 28, wherein the front wall is angled towards the back wall and lies on a plane that forms an angle X with the central axis of the lock ring, wherein angle X is between about 20 and 60 degrees.

30. The apparatus of claim 29, wherein angle X is about 36 degrees.

31. The apparatus of claim 29, wherein a rounded bottom wall connects the front wall with the back wall.

32. A connector apparatus comprising:

a socket, comprising:

a socket housing;

an insulator disposed within said socket housing;

a first contact disposed within said insulator;

a lock ring disposed about a distal end of said housing;

a shroud disposed about said distal end of said socket housing and said lock ring and moveable relative to said socket housing between a first position and a second position, said shroud having an outer wall and an inner wall, wherein, said shroud and said lock ring are configured so that when said shroud moves from said first position to said second position, said inner wall contacts said lock ring and causes said lock ring to flex outwardly; and a plug comprising:

a generally cylindrical, conductive plug housing that houses an insulator and a contact disposed within the insulator, wherein, on its outer wall, the plug housing has a protuberance having a first sloping surface on one side thereof and a second sloping surface on an opposite side thereof, wherein, the socket is configured such that when the plug is inserted into the distal end of the socket and locked in place by the lock ring, the lock ring exerts an axial force on the protuberance of the plug housing, but the axial force does not cause the front surface of the plug housing to press against (a) any electrically conductive surface of the socket or (b) any electrically conductive component of the socket.

33. The apparatus of claim 32, wherein the inner wall of the shroud has two major surfaces, an inner surface and an outer surface, wherein the outer surface of the inner wall is not parallel with the inner surface of the inner wall so that the two surfaces converge to form an annular ridge.

34. The apparatus of claim 32, wherein the socket further comprises a ground contact housed within said socket housing, wherein said ground contact is metallic and is configured to electrically connect the socket housing with plug housing when the plug housing is fully inserted into the socket housing.

35. The apparatus of claim 34, wherein the ground contact is annular.

36. The apparatus of claim 34, wherein the ground contact is in the form of a split ring.

37. The apparatus of claim 34, wherein the ground contact is housed within an annular groove located in an inner surface of the socket housing.

38. The apparatus of claim 37, wherein the ground contact is arranged so that it is coaxial with the socket housing.

39. The apparatus of claim 34, wherein the ground contact includes a first split ring, a second split ring and one or more generally U shaped contacts connecting the first split ring with the second split ring, wherein the split rings are arranged so that they are coaxial.

40. The apparatus of claim 39, wherein the first split ring and the second split ring have substantially the same inner and outer diameters, but the width of the first split ring is substantially greater then the width of the second split ring.

41. The apparatus of claim 40, wherein the generally U shaped contacts curve inwardly towards the central axis of the ground contact.

42. The apparatus of claim 32, wherein the lock ring comprises a base ring and a finger attached to the base ring, wherein the finger extends in the same general direction as the central axis of the base ring.

43. The apparatus of claim 42, wherein the longitudinal axis of the finger is generally parallel but not precisely parallel with the central axis of the base ring such that there is about a two (2) degree angle between the longitudinal axis of the finger and the central axis of the lock ring.

44. The apparatus of claim 43, wherein the finger has a proximal end connected to the base ring, an opposite distal end, and a lock tab spaced inwardly from the distal end, wherein the lock tab projects from an inner surface of the finger towards the central axis of the lock ring.

45. The apparatus of claim 44, wherein the lock tab has a planar back wall generally facing the proximal end and a planar front wall generally facing distal end, wherein the back wall lies on a plane that forms an angle Y with the central axis of the lock ring, wherein angle Y is about 90 degrees.

46. The apparatus of claim 45, wherein the front wall is angled towards the back wall and lies on a plane that forms an angle X with the central axis of the lock ring, wherein angle X is between about 20 and 60 degrees.

47. The apparatus of claim 46, wherein angle X is about 36 degrees.

48. The apparatus of claim 46, wherein a rounded bottom wall connects the front wall with the back wall.

* * * * *